US005193349A

United States Patent [19]

Laverman et al.

[11] Patent Number: 5,193,349

[45] Date of Patent: Mar. 16, 1993

[54] METHOD AND APPARATUS FOR COOLING HIGH TEMPERATURE SUPERCONDUCTORS WITH NEON-NITROGEN MIXTURES

[75] Inventors: Royce J. Laverman, South Holland; Ban-Yen Lai, Hinsdale, both of Ill.

[73] Assignee: Chicago Bridge & Iron Technical Services Company, Oak Brook, Ill.

[21] Appl. No.: 740,072

[22] Filed: Aug. 5, 1991

[51] Int. Cl.[5] ..... F25B 19/00; F25D 17/02

[52] U.S. Cl. ..... 62/64; 62/46.1; 62/48.1; 62/51.1; 62/51.3; 62/114; 505/888; 505/899

[58] Field of Search ..... 62/51.2, 64, 114, 46.1, 62/48.2, 51.3; 252/67; 505/888, 899

[56] References Cited

U.S. PATENT DOCUMENTS

| | | | |
|---|---|---|---|
| 3,733,845 | 5/1973 | Lieberman | 62/114 X |
| 3,854,913 | 12/1974 | Leyarovski et al. | 62/12 |
| 3,854,914 | 12/1974 | Leyarovski et al. | 62/12 |
| 3,889,485 | 6/1975 | Swearingen | 62/114 X |
| 4,183,225 | 1/1980 | Politte et al. | 62/114 |
| 4,209,657 | 6/1980 | Inai et al. | 62/51.3 X |
| 4,332,136 | 6/1982 | Quack | 62/48.2 |
| 4,680,936 | 7/1987 | Sarwinski et al. | 62/45 |
| 4,689,439 | 8/1987 | Sato | 62/51.3 X |
| 4,765,813 | 8/1988 | Gaumer, Jr. et al. | 62/20 |
| 4,857,504 | 8/1989 | Hermann et al. | 505/1 |
| 4,859,652 | 8/1989 | Block | 505/1 |
| 4,861,751 | 8/1989 | Tenhover | 505/1 |
| 4,873,444 | 10/1989 | Cooke et al. | 250/337 |
| 4,891,951 | 1/1990 | Ishibashi | 62/51.3 |
| 4,920,095 | 4/1990 | Ishigaki et al. | 505/1 |
| 4,931,424 | 6/1990 | Henty | 505/1 |
| 4,960,752 | 10/1990 | Ashok et al. | 505/1 |
| 4,962,083 | 10/1990 | Hermann et al. | 505/1 |
| 4,965,244 | 10/1990 | Weaver et al. | 505/1 |
| 5,038,571 | 8/1991 | Yokouchi et al. | 62/46.1 |
| 5,077,979 | 1/1992 | Skertic et al. | 62/51.2 |

OTHER PUBLICATIONS

Derwent Abstracts, Accension No. 88-169272/25, EP-271,989, Jun. 1988.

Derwent Abstracts, Accension No. 84-181761/29, SU-1,054,400, Nov. 1983.

Derwent Abstracts, Accension No. 78-52963A/29, SU-573,496, Oct. 1977.

Derwent Abstracts, Accension No. 75-08571W/05, SU 333,857, Sep. 1974.

Redlich, O. and J. N. S. Kwong, "On the Thermodynamics of Solutions; V An Equation of Sate and Fugacities of Gaseous Solutions", Chemical Reviews, No. 44, 1949, pp. 233-244.

Wilson, G. M., "A Modified Redlich-Kwong Equation of State; Application to General Physical Data Calculations", Presented at the 65th National AIChE Meeting, Cleveland, Ohio, May 4-7, 1969.

Wilson, G. M. and W. DeVaney, "Mark V Computer Program; Instructions and Documentation", Developed by P-V-T, Inc., Houston, Tex., Distributed by Natural Gas Processors Association, 1969.

Streett, W. B., "Liquid-Vapour Equilibrium in the System Neon-Nitrogen", Cryogenics, vol. 5, Feb., 1965, pp. 27-33.

(List continued on next page.)

*Primary Examiner*—Henry A. Bennet
*Assistant Examiner*—Christopher Kilmer
*Attorney, Agent, or Firm*—Marshall, O'Toole, Gerstein, Murray & Bicknell

[57] ABSTRACT

Apparatus and methods for cooling high temperature superconducting materials (HTSC) to superconductive temperatures within the range of 27° K. to 77° K. using a mixed refrigerant consisting of liquefied neon and nitrogen containing up to about ten mole percent neon by contacting and surrounding the HTSC material with the mixed refrigerant so that free convection or forced flow convection heat transfer can be effected.

38 Claims, 5 Drawing Sheets

OTHER PUBLICATIONS

Streett, W. B. "Density and Phase Equilibria In the System Neon-Nitrogen at High Pressures", Cryogenics, vol. 8, Apr., 1968, pp. 88-93.

American Society of Heating, Refrigerating and Air--Conditioning Engineers, Inc., "Thermodynamic Properties of Refrigerants", Published by ASHRAE, Altanta, Ga., 1986, pp. 459-472.

Asami, T. and H. Ebisu, "Thermodynamic Properties of Nitrogen Calculated From the BWR Equation of State", Cryogenics, vol. 29, Oct., 1989, pp. 995-997.

Asami, T. and H. Ebisu, "Thermodynamic Properties of Oxygen Calculated From the BWR Equation of State With Eight Newly Determined Coefficients", Cryogenics, vol. 30, Feb., 1990, pp. 113-115.

Benedict, M. G. B. Webb and L. C. Rubin, Journal of Chemical Physics, vol. 8, 1940, pp. 334-345.

Benedict, M. G. B. Webb and L. C. Rubin, "An Empirical Equation for Thermodynamic Properties of Light Hydrocarbons and Their Mixtures: II. Mixtures of Methane, Ethane, Propane and n-Butane", Journal of Chemical Physics, vol. 10, Dec., 1942, pp. 747-758.

Benedict, M. G. B. Webb and L. C. Rubin, "An Empirical Equation for Thermodynamic Properties of Light Hydrocarbons and Their Mixtures: Constants for Twelve Hydrocarbons", Chemical Engineeering Progress, vol. 47, No. 8, Aug., 1951, pp. 419-422.

Katti, R., R. T. Jacobsen, R. B. Stewart, and M. Jahangiri, "Thermodynamic Properties of Neon for Temperatures From the Triple Point to 700 K. at Pressures to 700 MPa", Advances in Cryogenic Engineering, vol. 31, Plenum Press, New York, 1986, pp. 1189-1197.

Stotler, H. H. and M. Benedict, "Correlation of Nitrogen-Methane Vapor-Liquid Equilibria by Equation of State", Chemical Engineering Symposium Series, vol. 49, No. 6, 1953, pp. 25-36.

METHOD AND APPARATUS FOR COOLING HIGH TEMPERATURE SUPERCONDUCTORS WITH NEON-NITROGEN MIXTURES

This invention was made with U.S. Government support under Contract No. ACK 85197 awarded by the U.S. Department of Energy. The U.S. Government has certain rights in this invention.

This invention relates to high temperature superconducting apparatus and methods and a mixed refrigerant or cooling liquid comprising nitrogen and neon useful therein.

BACKGROUND OF THE INVENTION

In recent years, a substantial amount of research and engineering effort has been directed to the storage of electrical energy so that it would be available quickly and efficiently when needed, such as during high energy demand periods in the summer for air conditioning and in the winter for heating. It is also desirable to store electrical energy produced during the nighttime when consumption is low so that it is available for daytime use for peak shaving when demand is much greater, thereby permitting a power plant to run at a more uniform rate.

Electrical energy storage also may be used when it is desirable to generate power at a lower rate and perhaps at a different time than at which it will be consumed, store the generated power in the form of electrical energy and subsequently release the stored energy to meet high rate consumption demands.

One form of electrical energy storage which has been studied extensively is the superconducting magnetic energy storage (SMES) apparatus which is intended to operate at very low temperatures, i.e. cryogenic temperatures. One such system comprises a circular coil surrounded by a coil containment vessel containing liquefied helium at a temperature of 1.8° K. The liquefied helium cools the coil to make it superconducting by lowering its electrical resistance. The coil containment vessel in turn may be surrounded by other structures such as a vacuum vessel and a shroud between the coil containment vessel and the vacuum vessel, but surrounding the coil containment vessel, to reduce heat transfer. The entire apparatus may be installed in a large circular trench or tunnel having inner and outer circumferential walls constructed to accept the radial loads applied during operation of the SMES apparatus.

Although very low temperature SMES apparatus and processes have been studied extensively using liquefied helium as the refrigerant or cooling liquid, there has been a continuing interest in SMES which utilizes high temperature superconducting (HTSC) materials which operate at higher temperatures, and particularly between the normal boiling point temperature of liquefied neon (27.09° K.) and the normal boiling point temperature of liquefied nitrogen (77.36° K.). Since a specific HTSC material may not likely give optimum SMES performance at the boiling point of liquefied neon or the boiling point of liquefied nitrogen, a cooling liquid is required which can supply the desired cooling for optimum performance within the temperature range from about 27° K. to 77° K. However, no single component cryogenic cooling liquid is available which is suitable for cooling a HTSC material to any specific optimum SMES performance temperature within the 27° K. to 77° K. temperature range.

The thermodynamic properties of single component cryogenic fluids which can be considered for use in cooling HTSC materials are summarized in Table 1.

TABLE 1

Thermodynamic Properties Of Cryogenic Fluids

| Cryogenic Fluid | Triple Point Temperature | Normal Boiling Point Temperature | Critical Point Temperature | Critical Point Pressure |
|---|---|---|---|---|
| Helium-4 | −455.76° F.<br>2.17° K. | −452.09° F.<br>4.21° K. | −450.31° F.<br>5.20° K. | 33.21<br>psia |
| n-Hydrogen | −434.56° F.<br>13.95° K. | −422.97° F.<br>20.39° K. | −399.95° F.<br>33.18° K. | 190.75<br>psia |
| Neon | −415.49° F.<br>25.54° K. | −410.90° F.<br>27.09° K. | −379.66° F.<br>44.45° K. | 394.73<br>psia |
| Nitrogen | −346.01° F.<br>63.15° K. | −320.41° F.<br>77.36° K. | −232.50° F.<br>126.21° K. | 493.00<br>psia |
| Carbon Monoxide | −337.02° F.<br>68.14° K. | −312.74° F.<br>81.63° K. | −220.43° F.<br>132.91° K. | 507.44<br>psia |
| Argon | −308.83° F.<br>83.80° K. | −302.57° F.<br>87.28° K. | −188.12° F.<br>150.86° K. | 710.40<br>psia |
| Oxygen | −361.84° F.<br>54.35° K. | −297.35° F.<br>90.18° K. | −181.08° F.<br>154.77° K. | 736.86<br>psia |

The liquid temperature range of a specific cryogenic fluid listed in Table 1 extends from its triple point temperature to its critical point temperature. Thus, it is not possible to provide continuous liquid phase cooling of HTSC materials with the single component cryogenic fluids in Table 1 within the temperature range from about 27° K. to 77° K. and at about atmospheric pressure.

It is desirable that the cryogenic cooling liquid used to cool HTSC materials operate at a low non-vacuum pressure, i.e. near atmospheric pressure. Liquid cooling of HTSC materials in the lower portion of the temperature range from 27° K. to 77° K. could be effected by using high pressure liquid neon below its critical point temperature of 44.40° K., but this would require a system that operates at high pressures, involving additional construction costs and operational problems. Likewise, liquid cooling of HTSC materials in the upper portion of the temperature range from 27° K. to 77° K. could be performed by using subcooled liquid nitrogen down to its triple point temperature of 63.15° K., but this would require a system that operates under vacuum conditions, again involving additional construction costs and operational problems.

Although the above discussion has been directed specifically to SMES apparatus and methods, it applies equally well to the liquid cooling of apparatus utilizing HTSC materials for other purposes including superconducting power transmission lines, electric generators and transformers, levitation apparatus using superconducting magnets such as for a railroad train, electric motors, magnetic separators, fusion magnets, magnetic resonance apparatus, supercollider apparatus, electromagnetic resonators, superconductive transistors, superconductive microwave cavity filters, electronic systems and electromagnetic launching equipment such as for a railgun.

From the above it is clear that a need exists for a suitable mixed refrigerant or cooling liquid as well as for apparatus and methods which employ HTSC materials and the needed cooling liquid.

SUMMARY OF THE INVENTION

According to one aspect of the invention, it has been discovered that liquid cooling of HTSC materials, particularly in the high temperature range of about 27° K. to 77° K., can be effected by use of a mixed refrigerant or cooling liquid comprising nitrogen and neon at temperatures and pressures which avoid solidification of the mixed cooling liquid.

A literature survey identified a few publications which reported vapor-liquid equilibrium data for neon-nitrogen mixtures. No publications, however, were located that contained freezing point data for these mixtures.

Accordingly, it was necessary to develop tables that list the thermodynamic properties of neon-nitrogen mixtures with the neon content ranging from 0 to 100% at pressures from 15 to 600 psia. The Redlich-Kwong (Chemical Reviews, No. 44, 1949, p. 233) equation of state as modified by Wilson (Presented at the 65th National AIChE Meeting, Cleveland, Ohio, May 4-7, 1969) (WRK equation) was used to investigate the thermodynamic properties of neon-nitrogen mixtures. The WRK equation is available as a computer program suitable for estimating thermodynamic properties of a wide variety of fluid mixtures. The computer program was developed by P-V-T, Inc., Houston, Tex. and was distributed by Natural Gas Processors Association, 1969, under the title "Mark V Computer Program; Instructions and Documentation".

The basic data required as input information to the computer program are the following:

1. Component critical pressure in psia.
2. Component critical temperature in °R.
3. Component acentric factor.
4. Component molecular weight.
5. Component ideal gas heat capacity constants.
6. Binary interaction coefficient for all binary combinations of components.

The values used in this analysis for neon and nitrogen are as listed below:

Component Critical Pressure, $P_c$

Neon: $P_c$=394.73 psia
Nitrogen: $P_c$493.00 psia

Component Critical Temperature, $T_c$

Neon: $T_c$=80.01° R.
Nitrogen: $T_c$=227.17° R.

Component Acentric Factor, $\omega$

The component acentric factor was calculated from the following equation by Pitzer:

$$\omega = -\log_{10}\left(\frac{P}{P_c}\right)_{TR=0.7} - 1.0$$

where the ratio ($P/P_c$) is evaluated at the condition when ($T/T_c$)=0.7. The resulting values of the component acentric factors are:

Neon: $\omega = -0.018517$
Nitrogen: $\omega = 0.045000$

Component Molecular Weight, M

Neon: M=20.183 lb/lb mole
Nitrogen: M=28.016 lb/lb mole

Component Ideal Gas Heat Capacity Constants, CA, CB, CC and CD

Data from the literature was used to develop the coefficients of the following polynomial equation for the component ideal heat capacity, $C_p°$, (cal/gm °K.).

$$C_p° = CA + CB(T, °K.) + CC(T, °K.)^2 + CD(T, °K.)^3$$

| Neon | Nitrogen |
|---|---|
| CA = 5.63644 | CA = 6.96 |
| CB = 0.00882423 | CB = 0 |
| CC = 0.000023833 | CC = 0 |
| CD = 0 | CD = 0 |

Binary Interaction Coefficient, $a_{ij}$

For the neon-nitrogen binary system, data from Streett (Cryogenics, Vol. 5, Feb. 1965, pp. 27-33) were used to determine the best binary interaction coefficient, $a_{ij}$, by an interactive process. The value determined was:

$$a_{ij}=0.853$$

Estimations of the bubble point temperature for neon-nitrogen mixtures, using the WRK equation Mark V Computer Program, indicated that a significant depression in the bubble point temperature results from only a small concentration of neon in the liquid phase. This is shown by the following Table 2.

TABLE 2

Bubble Point Temperatures of Neon-Nitrogen Mixtures From the WRK Equation

| Neon Concentration (mole %) | Bubble Point Temperature, (°K.) 14.7 (psia) | 20 (psia) | 50 (psia) | 100 (psia) | 200 (psia) |
|---|---|---|---|---|---|
| 0.00 | 77.60 | 80.27 | 89.63 | 98.32 | 108.94 |
| 0.25 | 66.32 | 72.58 | 86.44 | 96.62 | 108.07 |
| 0.50 | 44.87 | 54.56 | 82.31 | 94.65 | 107.09 |
| 0.75 | 37.34 | 42.64 | 76.31 | 92.40 | 106.04 |
| 1.00 | 33.71 | 37.60 | 66.13 | 89.72 | 104.91 |
| 1.25 | 31.46 | 34.66 | 54.52 | 86.41 | 103.68 |
| 1.50 | 29.89 | 32.67 | 47.88 | 82.13 | 102.35 |
| 1.75 | 28.73 | 31.21 | 43.86 | 76.12 | 100.86 |
| 2.00 | (1) | 30.20 | 41.08 | 67.71 | 99.22 |
| 2.50 | (1) | (1) | 37.39 | 53.93 | 95.26 |
| 3.00 | (1) | (1) | 34.99 | 47.27 | 89.80 |
| 3.50 | (1) | (1) | 33.28 | 43.28 | 81.25 |
| 4.00 | (1) | (1) | 31.98 | 40.55 | 68.01 |
| 4.50 | (1) | (1) | 30.97 | 38.53 | 58.08 |
| 5.00 | (1) | (1) | 30.28 | 36.95 | 52.37 |

NOTE: (1). Value not calculated.

The following Table 3 presents a comparison of measured and calculated bubble point pressures of neon-nitrogen mixtures.

TABLE 3

Comparison of Measured and Calculated Bubble Point Pressures of Neon-Nitrogen Mixtures From the WRK Equation

| Temperature (°K.) | Liquid Concentration of Neon (mole %) | Pressure Measured (1) (psia) | Pressure Calculated From the WRK Equation (psia) | Difference (2) (%) |
|---|---|---|---|---|
| 66.13 | 1.98 | 100.5 | 97.21 | 3.27 |
| | 3.87 | 192.0 | 190.35 | 0.86 |
| | 6.14 | 302.0 | 306.88 | −1.62 |

TABLE 3-continued

Comparison of Measured and Calculated Bubble Point Pressures of Neon-Nitrogen Mixtures From the WRK Equation

| Temperature (°K.) | Liquid Concentration of Neon (mole %) | Pressure Measured (1) (psia) | Pressure Calculated From the WRK Equation (psia) | Difference (2) (%) |
|---|---|---|---|---|
| | 8.28 | 397.0 | 417.25 | −5.10 |
| 77.50 | 1.25 | 79.5 | 77.39 | 2.65 |
| | 2.13 | 122.0 | 122.10 | −0.08 |
| | 3.25 | 179.0 | 179.58 | −0.32 |
| | 3.33 | 183.5 | 183.75 | −0.14 |
| | 4.44 | 240.0 | 241.48 | −0.62 |
| | 5.76 | 300.0 | 311.03 | −3.68 |
| | 7.82 | 404.0 | 421.78 | −4.40 |
| | 9.78 | 499.5 | 529.69 | −6.04 |
| 86.19 | 0.55 | 65.0 | 64.20 | 1.23 |
| | 1.16 | 95.0 | 94.86 | 0.15 |
| | 2.42 | 155.5 | 158.57 | −1.97 |
| | 3.34 | 201.5 | 205.44 | −1.96 |
| | 3.37 | 207.0 | 206.94 | 0.03 |
| | 5.12 | 296.5 | 296.79 | −0.10 |
| | 7.46 | 411.0 | 418.56 | −1.84 |
| | 9.37 | 500.0 | 519.29 | −3.86 |
| | | Average Absolute Difference = | | 2.00% |
| | | Standard Deviation = | | 2.48% |

NOTE:
(1) Streett, Cryogenics, Vol. 5, Feb. 1965, pp. 27-33.
(2) Difference is [(Measured - Calculated)/Measured] × 100.

Based on the described unexpected and advantageous thermodynamic properties of liquefied neon-nitrogen mixtures for cooling HTSC materials over a reasonably wide temperature for cooling HTSC materials over a reasonably wide temperature range, it has hereby been found possible to provide a novel apparatus comprising: an enclosed chamber capable of holding a cryogenic liquid; a high temperature superconducting (HTSC) material positioned within the enclosed chamber so as to be at least substantially surrounded by a cryogenic liquid; and a pool of cryogenic liquid in the chamber, said cryogenic liquid comprising a mixture of liquefied nitrogen and liquefied neon which maintains the HTSC material at a temperature at which it is superconductive.

It presently appears that the mixed refrigerant comprising the liquefied mixture of nitrogen and a small amount of neon can be used to maintain HTSC materials at their superconductive temperature in the range from about 27° K. to 77° K., regardless of the composition of the HTSC material and its use. Some examples of specific compositions of HTSC materials that are superconductive within the temperature range from 27° K. to 77° K. are listed in Table 4:

TABLE 4

Examples Of HTSC Materials That Are Superconductive Within The Temperature Range From 27° K. TO 77° K.

| HTSC Material Composition | Superconducting Temperature, (°K.) |
|---|---|
| Lanthanum-barium-copper oxide | 30 |
| Lanthanum-strontium-copper oxide | 36 |
| Yttrium-barium-copper oxide | 77 |

The HTSC material may be located in a volume of a static or flowing liquefied neon-nitrogen mixture so as to effect free or forced convection heat transfer between the HTSC material and the mixed refrigerant.

When the HTSC material is cooled by free convection heat transfer, the HTSC material may be positioned in an enclosed space containing a large enough volume to contain a reserve amount of the liquefied neon-nitrogen refrigerant mixture so as to maintain the HTSC material cool for a reasonable time if there is a breakdown in the refrigeration system used to produce the liquefied refrigerant mixture.

When the HTSC material is cooled by forced convection heat transfer, it is generally desirable to provide a first enclosed space large enough to store a reserve supply or volume of the liquefied refrigerant mixture from which the liquefied refrigerant mixture can be force-fed to and through a second enclosed space containing an HTSC material to be cooled by surrounding and contacting it with a flowing stream or volume of the liquefied neon-nitrogen refrigerant mixture.

The liquefied refrigerant mixture desirably contains up to about 10 mole percent of neon. The exact composition of the liquefied neon-nitrogen refrigerant mixture is to be selected so that the bubble point temperature of the mixture is below the temperature required to maintain a specific HTSC material superconductive. Furthermore, the pressure in the first and second enclosed chambers is preferably in the range of about 14 psia to about 20 psia so that the enclosed chambers may be structurally strong enough to handle the load.

The enclosed chamber for free convection cooling of an HTSC material, or for storing a reserve amount or volume of the liquefied refrigerant mixture for forced flow convection cooling, can have an outlet for removing a gaseous stream having a composition which is at least 95% neon; refrigeration means for reliquefying the gaseous stream removed from the enclosed chamber to produce a liquefied stream which is at least 95% neon; and means for returning the liquefied stream which is at least 95% neon to the enclosed chamber.

A mixing container can be included, together with means to withdraw a nitrogen-rich liquefied neon-nitrogen mixture stream from the enclosed chamber and feed it to the mixing container, means for feeding a neon-rich (which is at least 95% neon) partially liquefied stream to the mixing container, and a means to return the combined streams from the mixing container to the enclosed chamber. This arrangement can be used for free convection cooling. However, for forced convection cooling, the nitrogen-rich liquefied neon-nitrogen mixture stream is withdrawn from the second enclosed chamber, which contains the HTSC material, and is fed to the mixing container.

The neon-rich partially liquefied neon-nitrogen mixture stream (which is at least 95% neon), produced by the refrigeration means can be fed to apparatus which includes a separator vessel capable of receiving the neon-rich partially liquefied neon-nitrogen mixture stream (which is at least 95% neon), at a high pressure of about 100 psia and a low temperature of about −396° F. (or 35° K.); a conduit for delivering said partially liquefied neon-nitrogen mixture stream from the refrigeration means to the separator vessel; a conduit means communicating with the separator vessel for withdrawing a liquefied neon-nitrogen mixture stream from the separator vessel and feeding it to an expansion valve; and conduit means for receiving the cold lower pressure neon-nitrogen mixture stream expanded out of the expansion valve and feeding it directly or indirectly to the sole and/or first enclosed chamber into contact with the liquefied neon-nitrogen mixture therein.

Also provided by the invention is a neon-nitrogen mixture refrigeration system that utilizes either an expander or a liquefied nitrogen precooler. An important component in such refrigeration systems is the separator vessel which operates at temperature and pressure conditions such as to keep the liquefied neon-nitrogen mixture present in the separator vessel above its freezing point. The separator vessel contains a neon-rich liquid mixture which is generally at least 95% liquefied neon. Liquid from this separator vessel may be fed directly or indirectly into the liquefied neon-nitrogen mixture which surrounds or is intended to surround the HTSC material. In this way, the temperature of a nitrogen-rich liquid mixture in the enclosed chamber containing the HTSC material can be controlled. The heat from the HTSC material may be dissipated to the liquefied neon-nitrogen mixture surrounding it by either free convection or forced convection liquid cooling.

More specifically, the invention provides apparatus comprising an enclosed chamber capable of holding a cryogenic liquid; a high temperature superconducting material positioned within the enclosed chamber so as to be at least substantially surrounded by a cryogenic liquid; a pool of cryogenic liquid in the enclosed chamber, said cryogenic liquid comprising a mixture of liquefied nitrogen and liquefied neon; a first conduit means communicating with the enclosed chamber and with heat exchanger means and with compressor means for removing a gaseous stream therefrom having a composition which is at least 95% neon and feeding it to the heat exchanger means and the compressor means to pressurize and cool the gaseous stream to produce a cooled stream which is at least 95% neon; a second conduit means, including an expander, communicating with the first conduit means downstream of the compressors and upstream of some of the heat exchanger means, for withdrawing a cooled gaseous neon-nitrogen mixture from the first conduit means and delivering it to the expander and then feeding the further cooled gaseous neon-nitrogen mixture, expelled from the expander, to the first conduit; and a third conduit means communicating with the second conduit means downstream of the compressors and with the enclosed chamber, the third conduit means including expansion valve means, for feeding a cold neon-nitrogen mixture stream from the second conduit means, expanding the cold neon-nitrogen mixture stream through the expansion valve means to a lower pressure to produce a colder partially liquefied neon-nitrogen mixture stream and delivering the said colder partially liquefied neon-nitrogen mixture stream from the expansion valve means to the enclosed chamber.

Additionally provided is novel apparatus comprising an enclosed chamber capable of holding a cryogenic liquid; a high temperature superconducting material positioned within the enclosed chamber so as to be at least substantially surrounded by a cryogenic liquid; a pool of cryogenic liquid in the enclosed chamber, said cryogenic liquid comprising liquefied nitrogen and a small amount of liquefied neon; a first conduit means communicating with the enclosed chamber and with heat exchanger means and with compressor means for removing a gaseous stream therefrom having a composition which is at least 95% neon and feeding it to the heat exchanger means and the compressor means to pressurize and cool the gaseous stream to produce a cooled stream which is at least 95% neon; a second conduit means, communicating with the first conduit means downstream of the compressor means and upstream of some of the heat exchanger means, for withdrawing a cooled gaseous neon-nitrogen mixture from the first conduit means and delivering it to a cooling coil means located in a tank adapted to hold liquefied nitrogen and then feeding the further cooled gaseous neon-nitrogen mixture exiting the cooling coil means, to a third conduit means; and the third conduit means communicating with the second conduit means downstream of the compressors and communicating with the enclosed chamber, the third conduit means including expansion valve means, for feeding a cold neon-nitrogen mixture stream from the second conduit means, expanding the cold neon-nitrogen mixture through the expansion valve means to a lower pressure to produce a colder partially liquefied neon-nitrogen mixture stream and delivering the said colder partially liquefied neon-nitrogen mixture stream from the expansion valve means through the third conduit means to the enclosed chamber.

Also provided by the invention is a method of lowering the temperature of a high temperature superconducting material comprising positioning a high temperature superconducting (HTSC) material in an enclosed chamber capable of holding a cryogenic liquid; and surrounding the HTSC material with a pool of a cryogenic liquid comprising a mixture of liquefied neon and liquefied nitrogen. A gaseous stream having a composition which is at least 95% neon can be withdrawn from the enclosed chamber, the gaseous stream cooled to produce a liquefied stream and the said stream, which is at least 95% neon, returned to the enclosed chamber.

It is also feasible to remove a gaseous stream having a composition which is at least 95% neon from the enclosed chamber, reliquefy the gaseous stream removed from the enclosed chamber to produce a partially liquefied neon-cryogenic liquid stream comprising a nitrogen-rich liquefied neon-nitrogen mixture from the enclosed chamber and feed it to a mixing container; feed the colder neon-rich partially liquefied stream which is at least 95% neon into the mixing container into admixture with the cryogenic liquid stream; and withdraw the liquefied neon-nitrogen mixture from the mixing container and feed it into the enclosed chamber.

Another method is to remove a gaseous neon-nitrogen mixture stream having a composition which is at least 95% neon from the enclosed chamber; reliquefy the gaseous stream removed from the enclosed chamber to produce a partially liquefied neon-nitrogen mixture stream which is at least 95% neon; feed the partially liquefied neon-nitrogen mixture ream which is at least 95% neon into a separator vessel at a high pressure of at least 100 psia and a low temperature of 35° K; withdraw a liquefied neon-nitrogen mixture stream from the separator vessel and feed it to and through an expansion valve; and feed the colder lower pressure partially liquefied neon-nitrogen mixture stream, which is at least 95% neon, expanded out of the expansion valve, to the cryogenic liquid neon-nitrogen mixture in the enclosed chamber.

A more specific method provided by the invention comprises removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it; feeding the gaseous neon-nitrogen mixture stream which is at least 95% neon from the first heat exchanger (101) to a second heat exchanger (102) by means of a second conduit (70) communicating with the first heat exchanger (101) and the second heat exchanger (102) and feeding it through the second heat exchanger (102) to warm it; delivering the warmed neon-nitrogen mixture which is at least 95% neon from the second heat exchanger (102) to a first compressor (201) by means of a third conduit (72); delivering the compressed gaseous mixture which is at least 95% neon from the first compressor (201) to a third heat exchanger (103) by means of a fourth conduit (74) to cool the gaseous mixture; delivering the cooled gaseous mixture which is at least 95% neon from the third heat exchanger (103) to a second compressor (202) by means of a fifth conduit (76); delivering the cooled gaseous mixture which is at least 95% neon from the second compressor (202) to a fourth heat exchanger (104) by means of a sixth conduit (78) to further cool the gaseous mixture; delivering the cooled gaseous mixture which is at least 95% neon from the fourth heat exchanger (104) to the second heat exchanger (102) by means of a seventh conduit (80) to further cool the gaseous neon-nitrogen mixture; withdrawing a cooled gaseous stream of the neon-nitrogen mixture from the second heat exchanger (102) and delivering it to the first heat exchanger (101) by means of an eighth conduit (130); withdrawing a cooled gaseous neon-nitrogen mixture stream from the eighth conduit (130) and delivering it to an expander (134) by means of a ninth conduit (132); withdrawing a further cooled gaseous neon-nitrogen mixture stream from the expander (134) and delivering it to the second conduit (70) by means of a tenth conduit (136) so that the further cooled gaseous neon-nitrogen mixture stream from the expander (134) can mix with the gas stream which is at least 95% neon in the second conduit (70); withdrawing a neon-nitrogen mixture stream which is at least 95% neon from the first heat exchanger (101) and delivering it to a first expansion valve (36) by means of an eleventh conduit (34) and expanding the neon-nitrogen mixture stream through the valve to produce a partially liquefied neon-nitrogen mixture; feeding the partially liquefied neon-nitrogen mixture stream from the first expansion valve (36) to a separator vessel (40) by means of a twelfth conduit (38); withdrawing a liquefied neon-nitrogen mixture stream from the separator vessel (40), feeding it to a second expansion valve (46) by means of a conduit (44) and expanding the liquefied neon-nitrogen mixture stream through an expansion valve (46) to a lower pressure to cool it to a lower temperature; feeding the colder lower pressure neon-nitrogen mixture expanded out of the second expansion valve (46) to a mixing container (64) by means of conduit (48); withdrawing cryogenic liquid from the enclosed chamber (20) through conduit (58) and feeding it to a circulation pump (60); delivering cryogenic liquid from circulation pump (60) through a conduit (62) and feeding it to the mixing container (64) to form a colder cryogenic liquid mixture of liquefied nitrogen and liquefied neon therein; and feeding the colder cryogenic liquid mixture from the mixing container (64) through conduit (66) into contact with the cryogenic liquid in the enclosed chamber (20).

Another specific method according to the invention comprises removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it; feeding the neon-nitrogen mixture gaseous stream which is at least 95% neon from the first heat exchanger (101) to a second heat exchanger (102) by means of a second conduit (70) communicating with the first heat exchanger (101) and the second heat exchanger (102) and feeding it through the second heat exchanger (102) to further warm it; delivering the warmed gaseous neon-nitrogen mixture which is at least 95% neon from the second heat exchanger (102) to a first compressor (201) by means of a third conduit (72); delivering the compressed gaseous neon-nitrogen mixture stream which is at least 95% neon from the first compressor (201) to a third heat exchanger (103) by means of a fourth conduit (74) to cool the gaseous mixture; delivering the cooled gaseous neon-nitrogen mixture which is at least 95% neon from the third heat exchanger (103) to a second compressor (202) by means of a fifth conduit (76); delivering the cooled gaseous neon-nitrogen mixture which is at least 95% neon from the second compressor (202) to a fourth heat exchanger (104) by means of a sixth conduit (78) to further cool the gaseous mixture; delivering the cooled gaseous neon-nitrogen mixture which is at least 95% neon from the fourth heat exchanger (104) to the second heat exchanger (102) by means of a seventh conduit (80) to further cool the gaseous neon-nitrogen mixture; withdrawing the said gaseous neon-nitrogen mixture from the second heat exchanger (102) and delivering it to a cooling coil means (84) surrounded by a pool of liquefied nitrogen in a tank (90) by means of an eighth conduit (82); withdrawing a cooled gaseous neon-nitrogen mixture stream from the cooling coil means (84) and delivering it to the first heat exchanger (101) by means of a ninth conduit (99); withdrawing a neon-nitrogen mixture stream which is at least 95% neon from the first heat exchanger (101) and delivering it to a first expansion valve (36) by means of a tenth conduit (34) and expanding the neon-nitrogen mixture stream through the expansion valve (36) to produce a partially liquefied neon-nitrogen mixture; feeding the partially liquefied neon-nitrogen mixture stream from the first expansion valve (36) to a separator vessel (40) by means of an eleventh conduit (38); withdrawing a liquefied neon-nitrogen mixture stream from the separator vessel (40), feeding it to a second expansion valve (46) by means of a conduit (44) and expanding the liquefied neon-nitrogen mixture through the second expansion valve (46) to a lower pressure to cool it to a lower temperature; feeding colder lower pressure neon-nitrogen mixture expanded out of the second expansion valve (46) to a mixing container (64) by means of a conduit (48); withdrawing cryogenic liquid from the enclosed chamber (20) through conduit (58) and feeding it to a circulation pump (60); delivering cryogenic liquid from the circulation pump (60) through a conduit (62) and feeding it to the mixing container (64) to form a colder cryogenic liquid mixture of liquefied nitrogen and liquefied neon therein; and feeding the colder cryogenic liquid mixture from the mixing container (64) through conduit (66) into contact with cryogenic liquid in the enclosed chamber (20).

The invention furthermore provides a method of lowering the temperature of a high temperature superconducting (HTSC) material to a temperature at which it is superconductive comprising forming a pool of a cryogenic liquid comprising a mixture of liquefied nitrogen and a small amount of liquefied neon in a first enclosed chamber (20); continuously feeding a stream of the liquefied neon-nitrogen mixture from the first enclosed chamber (20) to a second enclosed chamber (203)

containing a HTSC material (204) so that the liquefied neon-nitrogen mixture surrounds the HTSC material (204) and flows through the second enclosed chamber (203) thereby cooling the HTSC material by forced flow convection heat transfer; and withdrawing the liquefied neon-nitrogen mixture from the second enclosed chamber (203).

The forced flow convection heat transfer method just summarized can include removing a gaseous stream having a neon-nitrogen mixture composition which is at least 95% neon from the first enclosed chamber (20), reliquefying the gaseous stream removed from the first enclosed chamber (20) to produce a partially liquefied neon-nitrogen mixture stream which is at least 95% neon and feeding the stream to a mixing container (64); feeding the neon-nitrogen mixture stream withdrawn from the second enclosed chamber (203) to the mixing container (64) to form a colder cryogenic liquid mixture of liquefied nitrogen and liquefied neon therein; and withdrawing the resulting colder cryogenic liquid mixture from the mixing container (64) and feeding it into the first enclosed chamber (20).

A more specific method of forced convection heat transfer which includes use of an expander comprises removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it; feeding the gaseous neon-nitrogen mixture stream which is at least 95% neon from the first heat exchanger (101) to a second heat exchanger (102) by means of a second conduit (70) communicating with the first heat exchanger (101) and the second heat exchanger (102) and feeding it through the second heat exchanger (102) to further warm it; delivering the warmed neon-nitrogen mixture which is at least 95% neon from the second heat exchanger (102) to a first compressor (201) by means of a third conduit (72); delivering the compressed gaseous mixture which is at least 95% neon from the first compressor (201) to a third heat exchanger (103) by means of a fourth conduit (74) to cool the gaseous mixture; delivering the cooled gaseous mixture which is at least 95% neon from the third heat exchanger (103) to a second compressor (202) by means of a fifth conduit (76); delivering the cooled gaseous mixture which is at least 95% neon from the second compressor (202) to a fourth heat exchanger (104) by means of a sixth conduit (78) to further cool the gaseous mixture; delivering the cooled gaseous mixture which is at least 95% neon from the fourth heat exchanger (104) to the second heat exchanger (102) by means of a seventh conduit (80) to further cool the gaseous neon-nitrogen mixture; withdrawing a cooled gaseous stream of the neon-nitrogen mixture from the second heat exchanger (102) and delivering it to the first heat exchanger (101) by means of an eighth conduit (130); withdrawing a cooled gaseous neon-nitrogen mixture stream from the eighth conduit (130) and delivering it to an expander (134) by means of a ninth conduit (132); withdrawing a further cooled gaseous neon-nitrogen mixture stream from the expander (134) and delivering it to the second conduit (70) by means of a tenth conduit (136) so that the further cooled gaseous neon-nitrogen mixture stream from the expander (134) can mix with the gas stream which is at least 95% neon in the second conduit (70); withdrawing a neon-nitrogen mixture stream which is at least 95% neon from the first heat exchanger (101) and delivering it to a first expansion valve (36) by means of an eleventh conduit (34) and expanding the neon-nitrogen mixture stream through the valve to produce a partially liquefied neon-nitrogen mixture; feeding the partially liquefied neon-nitrogen mixture stream from the first expansion valve (36) to a separator vessel (40) by means of a twelfth conduit (38); withdrawing a liquefied neon-nitrogen mixture stream from the separator vessel (40), feeding it to a second expansion valve (46) by means of a conduit (44) and expanding the liquefied neon-nitrogen mixture stream through the second expansion valve (46) to a lower pressure to cool it to a lower temperature; feeding the colder lower pressure neon-nitrogen mixture expanded out of the second expansion valve (46) to a mixing container (64) by means of a conduit (48); feeding the liquefied neon-nitrogen mixture stream withdrawn from the second enclosed chamber (203) to the mixing container (64) by means of a conduit (63) to form a colder cryogenic liquid mixture of liquefied nitrogen and liquefied neon therein; and withdrawing the colder cryogenic liquid mixture from the mixing container (64) and feeding it into the first enclosed chamber (20).

Another more specific method of forced convection heat transfer which uses liquefied nitrogen for cooling a gaseous neon-nitrogen mixture stream comprises removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it; feeding the neon-nitrogen mixture gaseous stream which is at least 95% neon from the first heat exchanger (101) to a second heat exchanger (102) by means of a second conduit (70) communicating with the first heat exchanger (101) and the second heat exchanger (102) and feeding it through the second heat exchanger (102) to further warm it; delivering the warmed gaseous neon-nitrogen mixture which is at least 95% neon from the second heat exchanger (102) to a first compressor (201) by means of a third conduit (72); delivering the compressed gaseous neon-nitrogen mixture stream which is at least 95% neon from the first compressor (201) to a third heat exchanger (103) by means of a fourth conduit (74) to further cool the gaseous mixture; delivering the cooled gaseous neon-nitrogen mixture which is at least 95% neon from the third heat exchanger (103) to a second compressor (202) by means of a fifth conduit (76); delivering the cooled gaseous neon-nitrogen mixture which is at least 95% neon from the second compressor (202) to a fourth heat exchanger (104) by means of a sixth conduit (78) to further cool the gaseous mixture; delivering the cooled gaseous neon nitrogen mixture which is at least 95% neon from the fourth heat exchanger (104) to the second heat exchanger (102) by means of a seventh conduit (80) to further cool the gaseous neon-nitrogen mixture; withdrawing the said gaseous neon-nitrogen mixture from the second heat exchanger (102) and delivering it to a cooling coil means (84), surrounded by a pool of liquefied nitrogen in a tank (90), by means of an eighth conduit (82); withdrawing a cooled gaseous neon-nitrogen mixture stream from the cooling coil means (84) and delivering it to the first heat exchanger (101) by means of a ninth conduit (99); withdrawing a neon-nitrogen mixture stream which is at least 95% neon from the first heat exchanger (101) and delivering it to a first expansion valve (36) by means of a tenth conduit (34) and expanding the neon-nitrogen mixture stream through the first expansion valve (36) to produce a partially liquefied neon-nitrogen mixture; feeding the partially liquefied neon-nitrogen mixture from the first expansion valve (36) to a separator vessel (40) by means of an eleventh conduit (38); withdrawing a liquefied neon-nitrogen mixture stream from the separator vessel (40), feeding it to a second expansion valve (46) by means of conduit (44) and expanding the liquefied neon-nitrogen mixture through the second expansion valve (46) to a lower pressure to cool it to a lower temperature; feeding the colder lower pressure neon-nitrogen mixture expanded out of the second expansion valve (46) to a mixing container (64) by means of a conduit (48); feeding the liquefied neon-nitrogen mixture stream withdrawn from the second enclosed chamber (203) to the mixing container (64) by means of a conduit (63) to form a colder cryogenic liquid mixture of liquefied nitrogen and liquefied neon therein; and withdrawing the colder cryogenic liquid mixture from the mixing container (64) and feeding it into the first enclosed chamber (20).

DETAILED DESCRIPTION OF THE DRAWINGS

To the extent that it is reasonable and practical, the same or similar elements which appear in the various views of the drawings will be identified by the same numbers.

Figure 1:
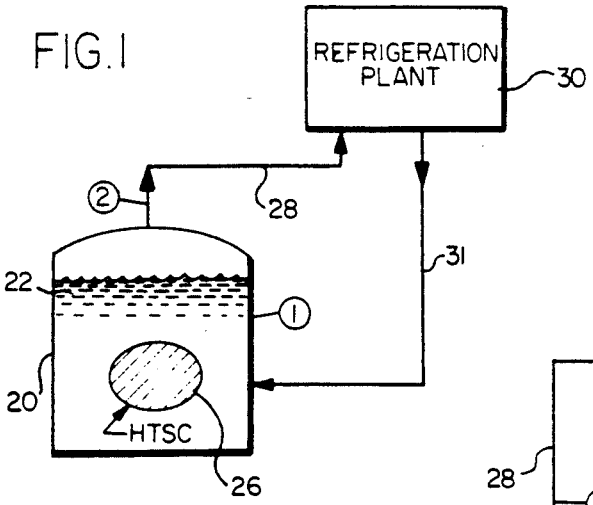
FIG. 1 is a schematic drawing illustrating apparatus including a high temperature superconducting material cooled in an enclosed chamber by a cyrogenic refrigerant liquid comprising a liquefied neon-nitrogen mixture and a refrigeration system to reliquefy refrigerant vapor that evaporates from the liquefied neon-nitrogen mixture.

The invention in one of its simplest embodiments is illustrated in FIG. 1. The tank (20) constitutes an enclosed chamber or space which contains a volume of cryogenic liquid (22) surrounding a high temperature superconducting material (HTSC) (26). The cryogenic liquid comprises a liquefied mixture of neon and nitrogen in which up to about 10 mole percent of the mixture is liquefied neon and the balance is liquefied nitrogen. Desirably, the vapor pressure in the tank (20) is in the range of about 14 to about 20 psia. The HTSC material is one which is superconductive in the temperature range of about 27° K. to 77° K. As illustrated by the data in Table 2, only a small amount of liquefied neon need be mixed with liquefied nitrogen to produce a lowering of the cryogenic liquid temperature and usually only up to 5 mole percent of liquefied neon need be included in the liquid mixture.

The HTSC material (26) in the tank (20) can be a simple solid block of material or it can be a component or part of any apparatus, machine or piece of equipment which is to be made superconductive.

The gaseous neon-nitrogen mixture which forms in tank (20), such as a result of heat generated by operation of a piece of equipment or apparatus in the tank, is removed by conduit (28) and fed to refrigeration plant (30). The gaseous neon-nitrogen mixture stream is converted to a liquefied neon-nitrogen mixture stream in refrigeration plant (30). This liquefied stream is then fed by conduit (31) into tank (20) to maintain the temperature, liquid mixture composition and pressure constant in the tank (20).

Figure 2:
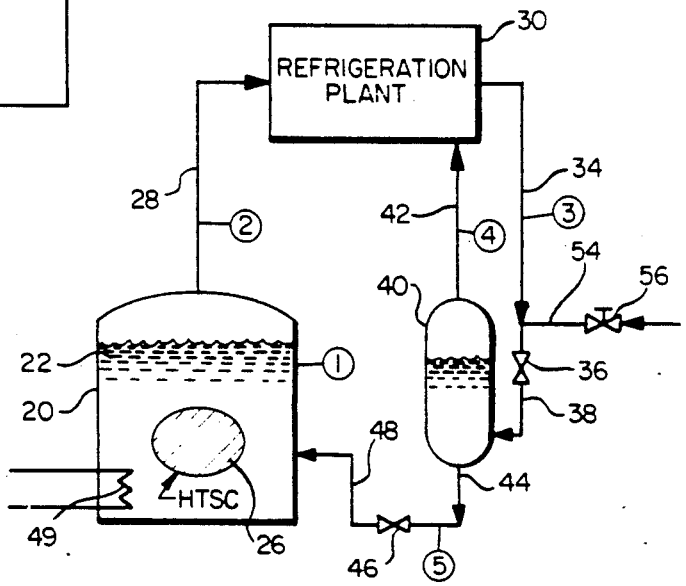
FIG. 2 is a schematic drawing similar to FIG. 1 but illustrating apparatus which includes expansion valves and a separator vessel for producing a cooled liquefied neon-nitrogen mixture which is returned to the enclosed chamber.

The HTSC material cooling apparatus illustrated in FIG. 2 is similar to that shown in FIG. 1. However, as shown in FIG. 2, conduit (34) receives a cold neon-nitrogen mixture stream from refrigeration plant (30) and delivers it to expansion valve (36) through which it is expanded to form a partially liquefied neon-nitrogen mixture which is fed to conduit (38) for delivery into separator vessel (40). The pressure in separator vessel (40) is selected to be above the freezing point temperature of the neon-nitrogen mixture at the prevailing condition. Vapor is collected in the upper internal space of separator vessel (40) and by means of conduit (42) it is returned to the refrigeration plant (30) to be converted to a cold high pressure gaseous neon-nitrogen mixture. A stream of liquefied neon-nitrogen mixture is withdrawn from the separator vessel (40) by means of conduit (44) and fed to second expansion valve (46). The liquefied neon-nitrogen mixture is expanded through expansion valve (46) to form a colder partially liquefied neon-nitrogen mixture which is then fed to conduit (48) and delivered to tank (20). In this method of operation, the neon-rich stream from the separator vessel (40) is flashed from the pressure in the separator vessel (40) to the pressure in the tank (20) resulting in a temperature reduction or cooling and generation of vapor in the stream that is injected by conduit (48) into tank (20). This flashed stream will cause mixing of the liquid in tank (20) to occur whereby a portion of the cooler neon will be dissolved into the liquid mixture in tank (20) thereby tending to lower its storage temperature. Neon gas which is not dissolved is returned, along with the boiloff from tank (20), through conduit (28) to the refrigeration plant (30).

Conduit (54) having valve (56) therein can be used to introduce liquefied neon into the system to adjust the binary neon-nitrogen mixture composition in tank (20). If lower temperatures are desired in tank (20), the neon concentration in the neon-nitrogen mixture may be increased by injecting neon-rich liquid from the separator vessel (40). If warmer temperatures are desired in tank (20), heater (49) in the tank can be used to heat the cryogenic liquid, thereby evaporating a neon-rich stream which is processed and reliquefied. The reliquefied neon-rich stream is then stored in the separator vessel (40) for use if it is desired to later reduce the temperature in tank (20) by reinjecting the neon-rich liquid from the separator vessel (40).

Figure 3:
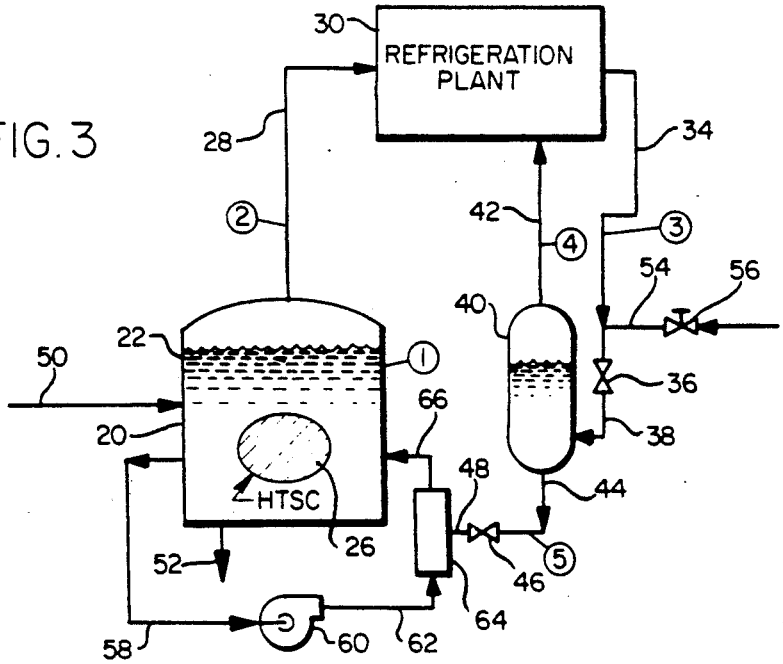
FIG. 3 is a schematic drawing similar to FIG. 2 but illustrating apparatus which includes a mixing container in which a partially liquefied neon-rich neon-nitrogen mixture stream is mixed with a liquefied nitrogen-rich neon-nitrogen mixture stream and the combined liquid mixture stream is fed to the enclosed chamber.

FIG. 3 illustrates an HTSC material cooling apparatus which incorporates a cryogenic liquid mixing system into the apparatus illustrated by FIG. 2. With reference to FIG. 3, conduit (50), which would contain a shut-off valve, provides a means to add liquefied nitrogen to tank (20). Also, conduit (54), having valve (56) therein, is used to add liquefied neon to the apparatus. Whenever it becomes desirable to remove some or all of the neon-nitrogen mixture, it can be drained out of the tank (20) through a conduit (52) which would contain a valve (not shown).

Further in regard to FIG. 3, the inlet of conduit (58) communicates with tank (20) and the outlet of conduit (58) communicates with a circulation pump (60). By means of conduit (58) a stream of nitrogen-rich liquefied neon-nitrogen mixture is withdrawn from tank (20) and fed to the circulation pump (60) which delivers it to conduit (62). Conduit (62) feeds the nitrogen-rich liquefied neon-nitrogen mixture to mixing container (64). The stream of the colder neon-rich partially liquefied neon-nitrogen mixture which exits conduit (48) is also fed to mixing container (64) wherein the nitrogen-rich stream from conduit (62) mixes with the colder neon-rich stream from conduit (48), resulting in a cooling of the stream from conduit (62). A stream of the cooled liquefied neon-nitrogen mixture is with lrawn from mixing container (64) by conduit (66) and is fed to tank (20). The purpose of the mixing container (64) is to maximize the cooling of the nitrogen-rich stream from tank (20) by the neon-rich stream from the separator vessel (40), resulting in a cooler stream that is returned to tank (20) by conduit (66). The liquid stream thus returned to tank (20) will have both a higher concentration of neon as well as a lower temperature when leaving the mixing container (64).

If it is desired to reduce the temperature in tank (20), it is necessary to increase the amount of dissolved neon in the neon-nitrogen liquid mixture therein. This may be done by increasing the flow rate of liquid from the separator vessel (40) to the mixing container (64). Thus, it is easy to control the temperature of the HTSC material by adjusting only the neon concentration of the liquid in tank (20).

The pressure of the fluid in the separator vessel (40) is to be selected so as to avoid the formation of solids in this vessel. The liquid in the separator vessel (40) contains only a small quantity of nitrogen, so it should be possible to go to a very low temperature (near 40° K.) without forming a solid in the separator vessel (40).

Figure 4:
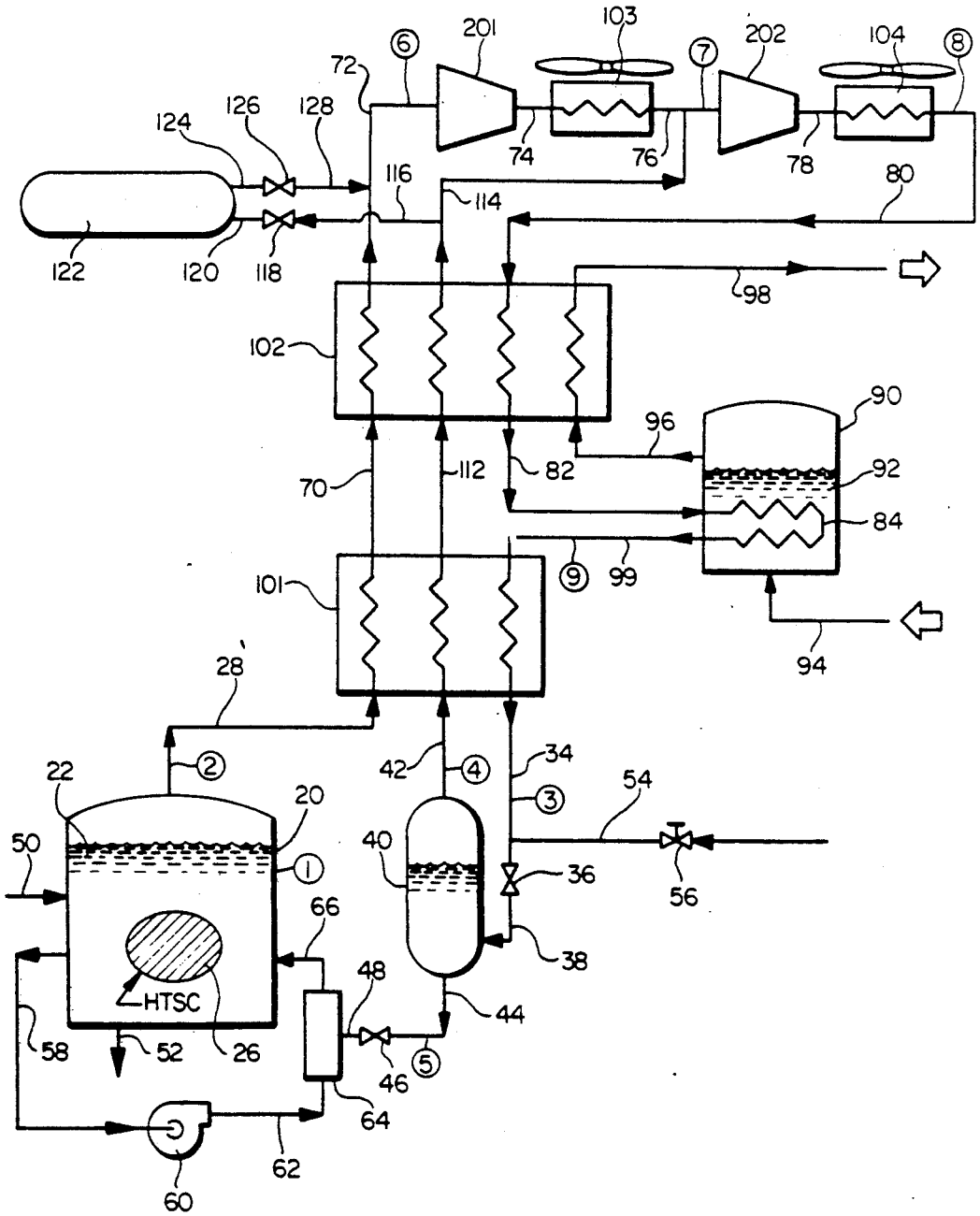
FIG. 4 is a schematic drawing of a liquefied nitrogen precooled neon-nitrogen mixture refrigeration system for cooling a high temperature superconducting material by free convection heat transfer in an enclosed chamber.

FIG. 4 illustrates an HTSC material cooling apparatus which incorporates the apparatus illustrated by FIG. 3 and a specific arrangement of equipment which constitutes a refrigeration plant that includes a liquefied nitrogen precooling system. Furthermore, the HTSC material is cooled by free convection heat transfer in tank (20), which is also the method by which cooling is effected in the apparatus illustrated by FIGS. 1 to 3. If it is desired to operate the HTSC at 50° K. and 15 psia, the mixed refrigerant will contain approximately 0.43 mole percent neon and the balance will be nitrogen, whereas the vapor leaving tank (20) by conduit (28) will contain approximately 99.55 mole percent neon. Thus, the gas mixture returned to the refrigeration system will contain only a small quantity of nitrogen. That stream is sometimes referred to herein and in the claims as the neon-rich stream and as the mixed refrigerant neon-rich stream.

The cold gaseous mixture of neon and nitrogen removed from the tank (20) by conduit (28) is passed through the first heat exchanger (101) to conduit (70) which feeds it to the second heat exchanger (102). The gaseous mixture is withdrawn from heat exchanger (102) by conduit (72) which delivers it to the first compressor (201). The gaseous neon-nitrogen mixture exits at an increased pressure from compressor (201) into conduit (74) which feeds it to the third heat exchanger (103). Conduit (76) receives the compressed gaseous mixture of neon and nitrogen from heat exchanger (103) and delivers it to the second compressor (202) in which it is further compressed. The pressurized gas mixture is fed from compressor (202) to conduit (78) which delivers the gas to the fourth heat exchanger (104). The cooled pressurized gas is withdrawn from heat exchanger (104) by conduit (80) which feeds it to heat exchanger (102) in which it is further cooled. The cooled gaseous neon-nitrogen mixture is withdrawn from second heat exchanger (102) by means of conduit (82) and fed to coil (84) located in tank (90).

Tank (90) contains a pool of liquefied nitrogen (92) supplied to the tank by conduit (94). Cold gaseous nitrogen boil-off is withdrawn from tank (90) by means of conduit (96) and fed to the second heat exchanger (102). The now warmer gaseous nitrogen is withdrawn from heat exchanger (102) by means of conduit (98) and used or disposed of as may be appropriate. Cold gaseous neon-nitrogen mixture is removed from coil (84) by conduit (99) which feeds it to the first heat exchanger (101) in which it is further cooled and then withdrawn by means of conduit (34) and further handled as described previously in regard to FIGS. 2 and 3.

Also in regard to FIG. 4, conduit (42) feeds the gaseous stream of cold neon-nitrogen mixture to the first heat exchanger (101) from which it is withdrawn by conduit (112) and fed to the second heat exchanger (102) from which the stream exits to conduit (114) which feeds it to conduit (76). The gas mixture or mixed refrigerant that is circulated through the refrigeration plant above or downstream of the second heat exchanger has a composition of nearly pure neon. This simplifies the analysis of the refrigeration cycle and permits an accurate design to be made of the refrigeration system.

The refrigeration system shown in FIG. 4 can be further improved by including a storage tank (122) to store for later use a pressurized gaseous neon-rich mixture when the composition of the liquefied neon-nitrogen mixture in tank (20) is to be altered to change the storage temperature to a somewhat higher value which requires less liquefied neon in the liquefied neon-nitrogen mixture in the tank (20). A neon-rich gaseous mixture may be removed from the refrigeration system and be sent to storage tank (122) through branch conduit (116) which communicates with conduit (114) and valve (118). Some of the neon-rich gaseous stream flowing in conduit (114) is diverted to conduit (116) and it passes through valve (118) into conduit (120) which feeds it into a storage tank (122). A neon-rich gaseous mixture may be added to the refrigeration system from storage tank (122) through conduit (124) which feeds it to valve (126). The neon-rich gaseous mixture is then fed from valve (126) to conduit (128) which delivers it to conduit (72), thereby to be fed to the first compressor (201).

Figure 5:
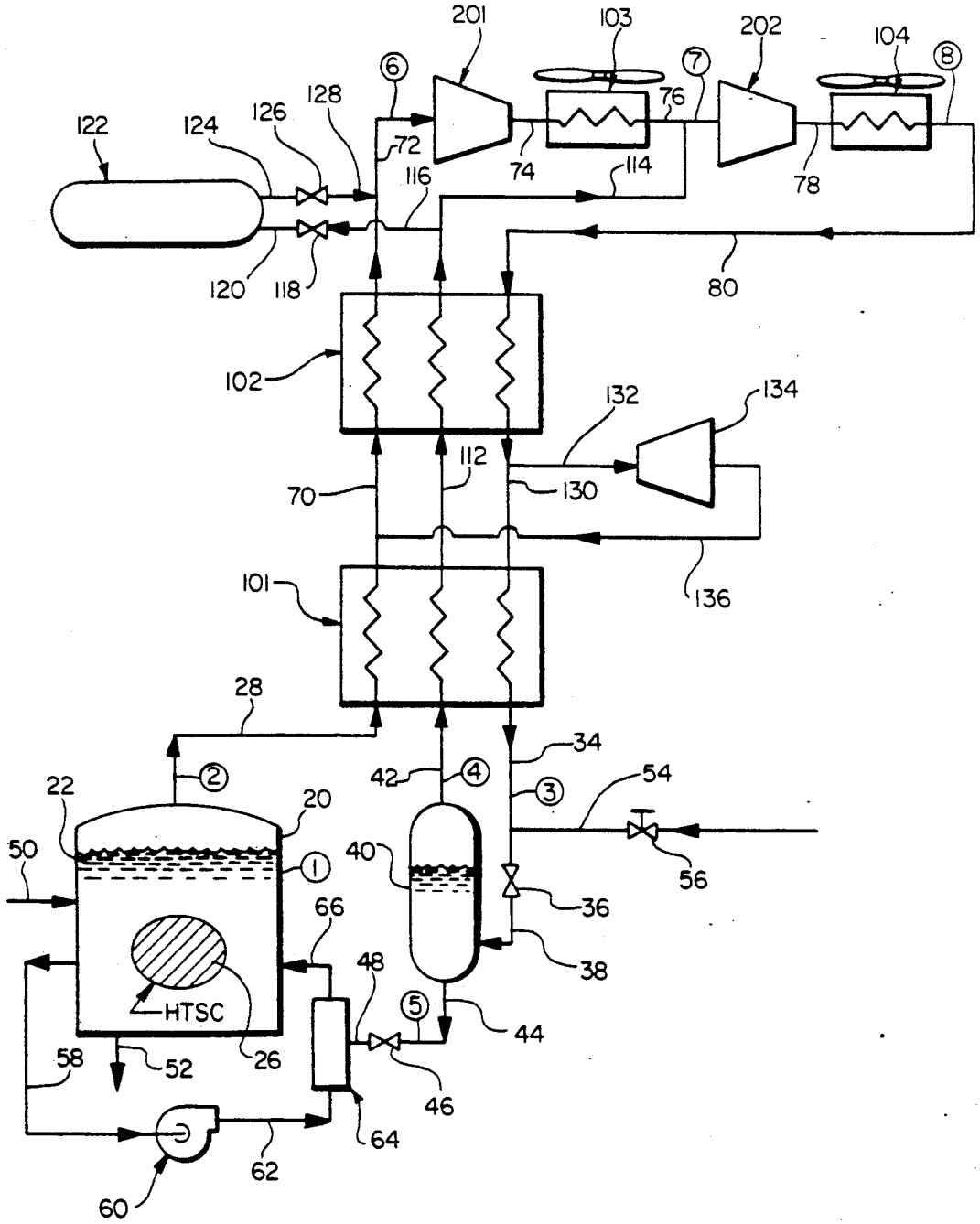
FIG. 5 is a schematic drawing of an expander type neon-nitrogen mixture refrigeration system for cooling a high temperature superconducting material by free convection heat transfer in an enclosed chamber.

The apparatus illustrated by FIG. 5 is identical to the apparatus illustrated in FIG. 4 except that the cooling equipment involving the liquefied nitrogen tank (90) has been replaced by an expander type cooling system. As shown in FIG. 5, high pressure gaseous neon-nitrogen mixture fed by conduit (80) to the second heat exchanger (102) is withdrawn from the heat exchanger by conduit (130) and fed to the first heat exchanger (101) where it is further cooled and then fed to conduit (34) for further processing as previously described.

Branch conduit (132) communicates with conduit (130) and is used to remove some of the cooled gaseous neon-nitrogen mixture and feed it to expander (134) from which the gas mixture exits into conduit (136) which delivers the lower pressure further cooled gas, comprising a mixture of neon and nitrogen, to conduit (70) so that it can be further processed in the refrigeration system as previously described.

Figure 6:
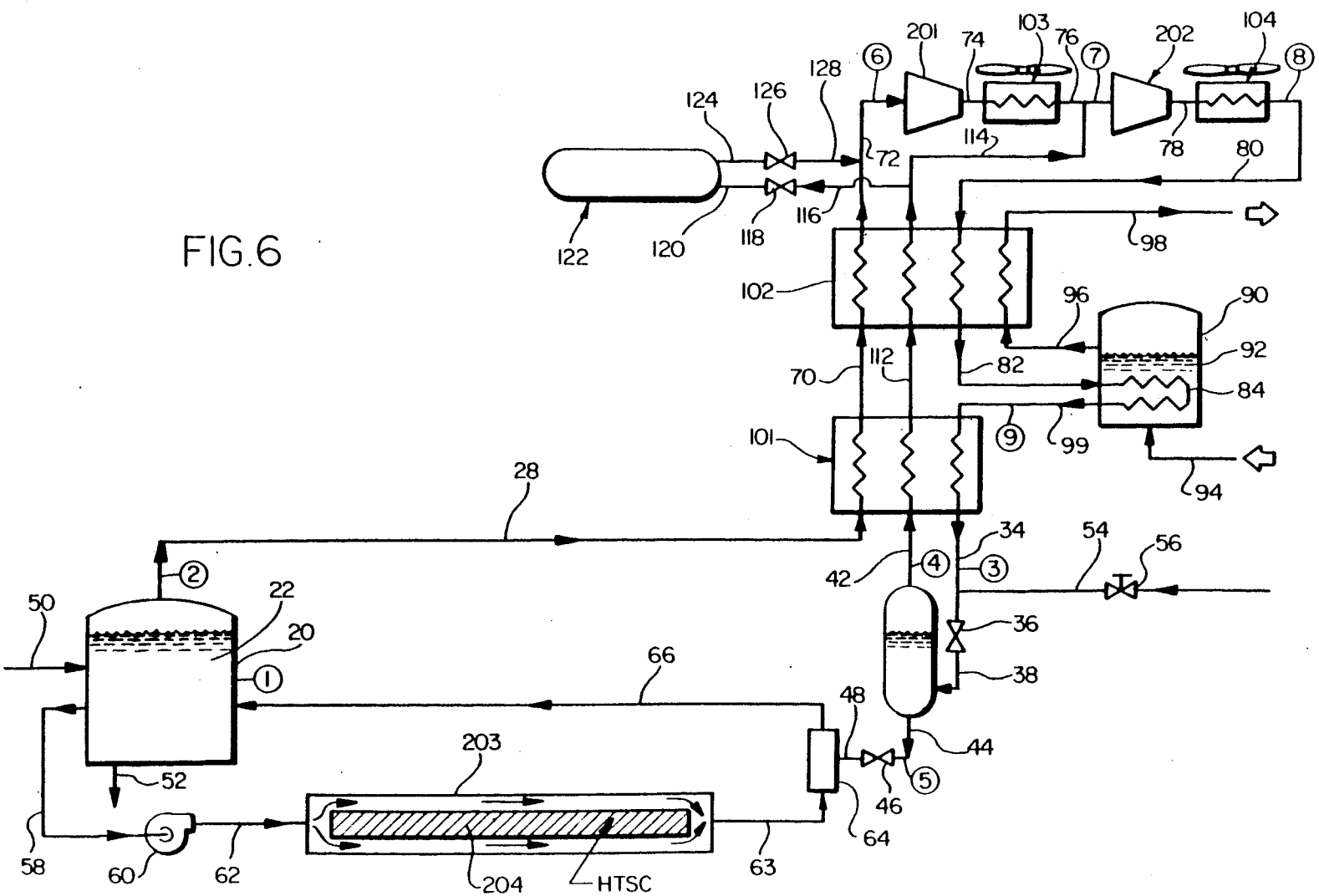
FIG. 6 is a schematic drawing of a liquid nitrogen precooled neon-nitrogen mixture refrigeration system for cooling a high temperature superconducting material by forced convection heat transfer in a flowing refrigerant circuit.

Turning now to FIG. 6, it will be seen that the apparatus illustrated in that figure is largely the same as the apparatus illustrated in FIG. 4. It will be seen in FIG. 6, however, that the HTSC material has been removed from enclosed chamber (20) and HTSC material (204) placed in an elongated second enclosed chamber (203). A stream of the liquefied neon-nitrogen mixture is fed by conduit (62) to the inlet end of enclosed chamber (203). The liquefied neon-nitrogen mixture flows through the enclosed chamber (203) around, and in forced convection heat transfer with, the HTSC material (204) in a flooded arrangement. The nitrogen-rich liquefied neon-nitrogen mixture is withdrawn from enclosed chamber (203) by a conduit (63) and fed to the mixing container (64).

Figure 7:
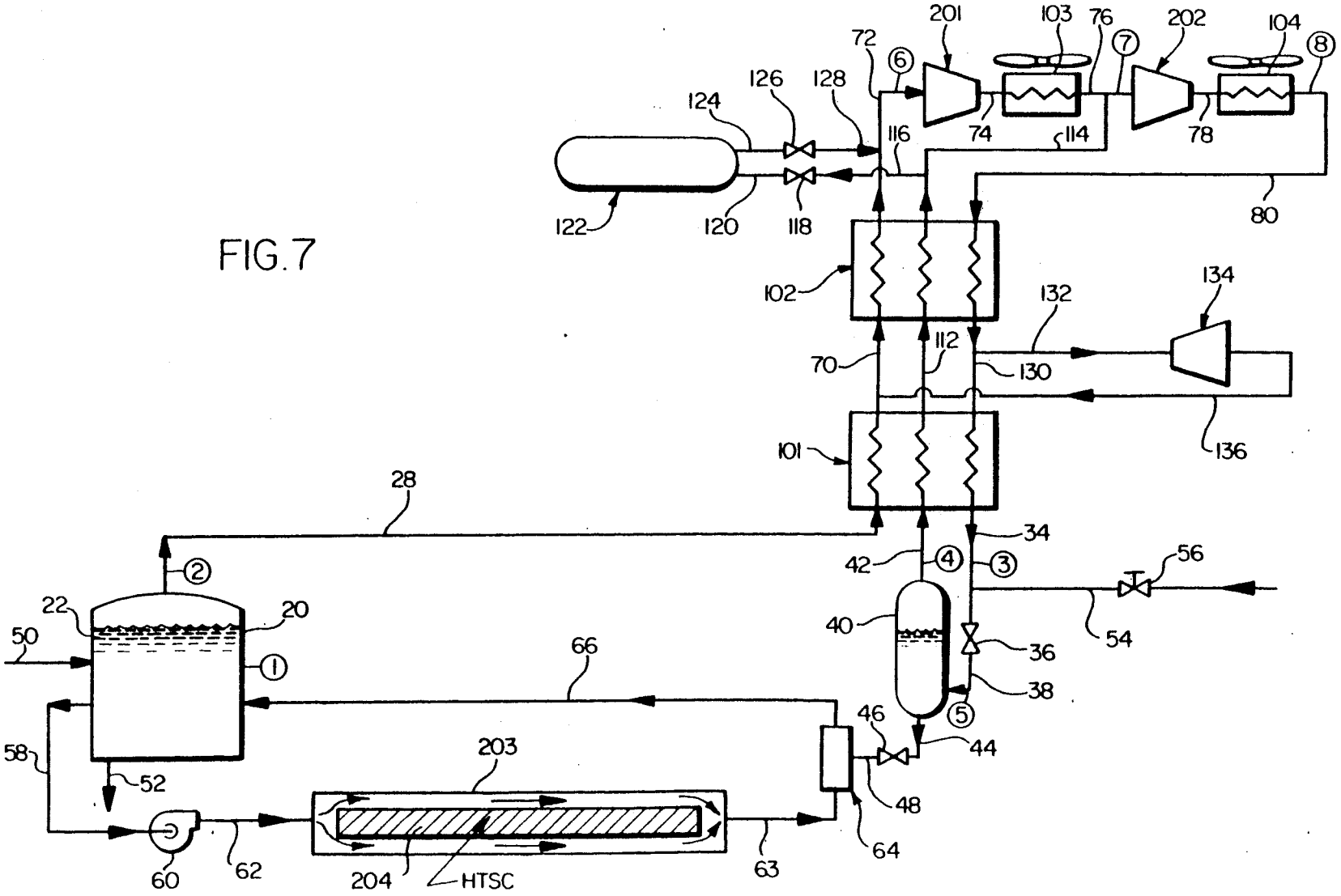
FIG. 7 is a schematic drawing of an expander type neon-nitrogen mixture refrigeration system for cooling a high temperature superconducting material by forced convection heat transfer in a flowing refrigerant circuit.

FIG. 7 will be seen to illustrate an apparatus essentially identical to that shown in FIG. 6 except that the liquefied nitrogen tank (90) and ancillary equipment has been replaced by an expander (134) and ancillary equipment, such as is described in detail in connection with FIG. 5. Thus, for an understanding of the apparatus of FIG. 7, one need only refer to the descriptions of FIGS. 5 and 6, making it unnecessary to further describe FIG. 7.

The following Table 5 sets forth typical conditions under which the systems illustrated in FIGS. 1 to 7 can operate. The point numbers referred to in Table 5 have reference to the corresponding circled numbers in these drawing figures.

limitations should be understood therefrom, as modifications will be obvious to those skilled in the art.

What is claimed is:

1. A method of lowering the temperature of a high temperature superconducting material comprising:
   - positioning a high temperature superconducting (HTSC) material (26) in an enclosed chamber (20) capable of holding a cyrogenic liquid (22);
   - surrounding the HTSC material (26) with a pool of a cryogenic liquid (22) comprising a mixture of liquefied neon and liquefied nitrogen;
   - removing a gaseous neon-nitrogen stream having a composition which is at least 95% neon from the enclosed chamber (20);
   - reliquefying the gaseous stream removed from the enclosed chamber (20) to produce a partially liquefied neon-rich stream which is at least 95% neon;
   - feeding the partially liquefied neon-rich stream which is at least 95% neon into a separator vessel (40) at a high pressure of at least 100 psia and a low temperature at least as low as 35° K.;
   - withdrawing a liquefied neon-rich stream from the separator vessel (40) and feeding it to and through an expansion valve (46);
   - receiving a cold lower pressure neon-rich stream, which is at least 95% neon, expanded out of the expansion valve (46) and feeding it to a mixing container (64);
   - withdrawing a liquefied neon-nitrogen stream from the enclosed chamber (20) and feeding it to the mixing container (64) to form a composite liquefied gas stream of the liquefied neon-nitrogen stream and the cold neon-rich stream in the mixing container (64); and
   - feeding the composite liquefied gas stream from the mixing container (64) into contact with the cyrogenic liquid (22) in the enclosed chamber (20).

2. A method according to claim 1 including:
   - withdrawing a neon-nitrogen mixture gas rich in neon from the separator vessel (40), reliquefying it and feeding it back to the separator vessel (40).

3. A method of lowering the temperature of a high temperature superconducting material comprising:
   - positioning a high temperature superconducting (HTSC) material (26) in an enclosed chamber (20) capable of holding a cryogenic liquid (22);
   - surrounding the HTSC material (26) with a pool of a cryogenic liquid (22) comprising a mixture of liquefied neon and liquefied nitrogen;
   - removing a gaseous stream of a neon-nitrogen mixture having at least 95% neon from the enclosed chamber (20) by means of a first conduit (28) communicating with the enclosed chamber (20) and a

TABLE 5

Typical Neon-Nitrogen Refrigeration System Conditions

| Thermodynamic Property | Units | Point 1 | Point 2 | Point 3 | Point 4 | Point 5 | Point 6 | Point 7 | Point 8 | Point 9 |
|---|---|---|---|---|---|---|---|---|---|---|
| Pressure | psia | 15 | 15 | 600 | 100 | 100 | 15 | 100 | 600 | 600 |
| Temperature | °F. | −370 | −370 | −370 | −396 | −396 | 80 | 80 | 90 | −310 |
| | °R. | 90 | 90 | 90 | 64 | 64 | 540 | 540 | 550 | 150 |
| | °K. | 50 | 50 | 50 | 35 | 35 | 300 | 300 | 306 | 83 |
| Composition: | | | | | | | | | | |
| Neon | mole % | 0.43 | 99.55 | 99.60 | 99.999 | 97.59 | 99.55 | 99.60 | 99.60 | 99.60 |
| Nitrogen | mole % | 99.57 | 0.45 | 0.40 | 0.001 | 2.41 | 0.45 | 0.40 | 0.40 | 0.40 |
| Phase | | Liquid | Vapor | Gas | Vapor | Liquid | Gas | Gas | Gas | Gas |

The foregoing detailed description has been given for clearness of understanding only, and no unnecessary first heat exchanger (101) and feeding it through the first heat exchanger (101) to warm it;

feeding the gaseous neon-rich stream which is at least 95% neon from the first heat exchanger (101) to a second heat exchanger (102) by means of a second conduit (70) communicating with the first heat exchanger (101) and the second heat exchanger (102);

delivering the warmed neon-rich stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to cool the gas;

delivering the cooled neon-rich gaseous stream which is at least 95% neon from the fourth heat exchanger (104) to the second heat exchanger (102) by means of a seventh conduit (80) to further cool the neon-rich stream;

withdrawing a cooled neon-rich gaseous stream from the second heat exchanger (102) and delivering it to the first heat exchanger (101) by means of an eighth conduit (130);

withdrawing a cooled neon-rich gaseous stream from the eighth conduit (130) and delivering it to an expander (134) by means of a ninth conduit (132);

withdrawing a further-cooled neon-rich gaseous stream from the expander (134) and delivering it to the second conduit (70) by means of a tenth conduit (136) so that the further cooled neon-rich gas stream can mix with the gas stream which is at least 95% neon in the second conduit (70);

withdrawing a cold neon-rich stream which is at least 95% neon from the first heat exchanger (101) and expanding the cold neon-rich stream to a lower pressure to produce a partially liquefied neon-rich stream; and delivering the said partially liquefied neon-rich stream into contact with the cryogenic liquid (22) in the enclosed chamber (20).

4. A method of lowering the temperature of a high temperature superconducting material comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen;

removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it;

feeding the gaseous neon-rich stream which is at least 95% neon from the first heat exchanger (101) to a second heat exchanger (102) by means of a second conduit (70) communicating with the first heat exchanger (101) and the second heat exchanger (102);

delivering the warmed neon-rich stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95%neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to cool the gas;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing a cooled neon-rich gaseous stream from the second heat exchanger (102) and delivering it to the first heat exchanger (101) by means of an eighth conduit (130);

withdrawing a neon-rich gaseous stream from the eighth conduit (130) and delivering it to an expander (134) by means of a ninth conduit (132);

withdrawing a further cooled neon-rich gaseous stream from the expander (134) and delivering it to the second conduit (70) by means of a tenth conduit (136) so that the further cooled neon-rich gaseous stream can mix with the gas stream which is at least 95% neon in the second conduit (70);

withdrawing a cold neon-rich stream which is at least 95% neon from the first heat exchanger (101) and delivering it to a first expansion valve (36) by means of an eleventh conduit (34) an expanding the stream through the first expansion valve (36) to produce a partially liquefied neon-rich stream;

feeding the partially liquefied neon-rich stream from the first expansion valve (36) to a separator vessel (40) by means of a twelfth conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding the cold lower pressure partially liquefied neon-rich stream expanded out of the second expansion valve (46) to a mixing container (64);

withdrawing a liquefied nitrogen-rich stream of cryogenic liquid (22) from the enclosed chamber (20) and feeding it to the mixing container (64) to form a composite liquefied gas stream, which is a mixture of the liquefied nitrogen-rich stream and the partially liquefied neon-rich stream; and feeding the composite liquefied gas stream from the mixing container (64) into contact with the cryogenic liquid (22) in the enclosed chamber (20).

5. A method according to claim 4 including:

withdrawing a neon-rich gas stream from the separator vessel (40) and feeding it through the first heat exchanger (101) and second heat exchanger (102) for indirect cooling purposes.

6. A method of lowering the temperature of a high temperature superconducting material comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen;

removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it;

feeding the warmed neon-rich gaseous stream which is at least 95% neon from the first heat exchanger (101) to a second heat exchanger (102) by means of a second conduit (70) communicating with the first heat exchanger (101) and the second heat exchanger (102);

delivering the warmed neon-rich gaseous stream mixture which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95% neon from the third heat exchanger (103) to a second compressor (202) by means of a fifth conduit (76);

delivering the compressed & gaseous stream which is at least 95% neon from the second compressor (202) to a fourth heat exchanger (104) by means of a sixth conduit (78) to cool the gas;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing the said cooled neon-rich gaseous stream from the second heat exchanger (102) and delivering it to a cooling coil means (84) located in a pool of liquefied nitrogen (92) in a tank (90);

withdrawing the further cooled neon-rich gaseous stream from the cooling coil means (84) and delivering it to the first heat exchanger (101) by means of a ninth conduit (99); and withdrawing a cold neon-rich stream, which is at least 95% neon, from the first heat exchanger (101), expanding the cold neon-rich stream to a lower pressure to produce a colder partially liquefied neon-rich stream and delivering the said colder partially liquefied neon-rich stream to the enclosed chamber (20).

7. A method of lowering the temperature of a high temperature superconducting material comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen;

removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it;

feeding the warmed neon-rich gaseous stream, which is at least 95% neon, from the first heat exchanger (101) to a second heat exchanger (102) by means of a second conduit (70) communicating with the first heat exchanger (101) and the second heat exchanger (102);

delivering the warmed neon-rich gaseous stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to cool the neon-rich gaseous stream;

delivering the cooled neon-rich gaseous stream which is at least 95% neon from the fourth heat exchanger (104) to the second heat exchanger (102) by means of a seventh conduit (80) to further cool the neon-rich gaseous s'ream;

withdrawing the said cooled neon-rich gaseous stream from the second heat exchanger (102) and delivering it to a cooling coil means (84) surrounded by liquefied nitrogen (92) in a tank (90) by means of an eighth conduit (82);

withdrawing the further cooled neon-rich gaseous stream from the cooling coil means (84) and delivering it to the first heat exchanger (101) by means of a ninth conduit (99);

withdrawing a cold neon-rich stream which is at least 95% neon from the first heat exchanger (101) and delivering it to a first expansion valve (36) by means of a tenth conduit (34) and expanding the cold neon-rich stream through the first expansion valve (36) to produce a partially liquefied neon-rich stream;

feeding the partially liquefied neon-rich stream from the first expansion valve (36) to a separator vessel (40) by means of an eleventh conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding the cold lower pressure partially liquefied neon-rich stream expanded out of the second expansion valve (46) to a mixing container (64);

withdrawing a liquefied nitrogen-rich stream of cryogenic liquid (22) from the enclosed chamber (20) and feeding it to the mixing container (64) to form a composite liquefied gas stream, which is a mixture of the liquefied nitrogen-rich stream and the partially liquefied neon-rich stream; and feeding the composite liquefied gas stream from the mixing container (64) into contact with the cryogenic liquid (22) in the enclosed chamber (20).

8. A method according to claim 7 comprising:

withdrawing a neon-rich gas stream from the separator vessel (40) and feeding it through the first heat exchanger (101) and second heat exchanger (102) for indirect cooling purposes.

9. A method of lowering the temperature of a high temperature superconducting (HTSC) material which has a superconducting capacity when at a temperature in the range of about 27° K. to 77° K. comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen, with the mixture containing up to about 10 mole percent of neon;

removing a gaseous stream of a neon-nitrogen mixture having at least 95% neon from the enclosed chamber (20) by means of a first conduit (28) communicating with the enclosed chamber (20) and a first heat exchanger (101) and feeding it through the first heat exchanger (101) to warm it;

feeding the warmed neon-rich gaseous stream which is at least 95% neon from the first heat exchanger (101) to a second heat exchanger (102) by means of a second conduit (70) communicating with the first heat exchanger (101) and the second heat exchanger (102);

delivering the warmed neon-rich gaseous stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to cool the neon-rich gaseous stream;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing a cooled neon-rich gaseous stream from the second heat exchanger (102) and delivering it to the first heat exchanger (101) by means of an eighth conduit (130);

withdrawing a neon-rich gaseous stream from the eighth conduit (130) and delivering it to an expander (134) by means of a ninth conduit (132);

withdrawing a further cooled neon-rich gaseous stream from the expander (134) and delivering it to the second conduit (70) by means of a tenth conduit (136) so that the further cooled neon-rich gas stream can mix with the gas stream which is at least 95% neon in the second conduit (70);

withdrawing a cold neon-rich stream which is at least 95% neon from the first heat exchanger (101) and delivering it to a first expansion valve (36) by means of an eleventh conduit (34) and expanding the cold neon-rich stream through the first expansion valve (36) to produce a partially liquefied neon-rich stream;

feeding the partially liquefied neon-rich stream from the first expansion valve (36) to a separator vessel (40) by means of a twelfth conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding the cold lower pressure partially liquefied neon-rich stream expanded out of the second expansion valve (46) to a mixing container (64);

withdrawing a liquefied nitrogen-rich stream of cryogenic liquid (22) from the enclosed chamber (20) and feeding it to the mixing container (64) to form a composite liquefied gas stream, which is a mixture of the liquefied nitrogen-rich stream and the partially liquefied neon-rich stream;

feeding the composite liquefied gas stream from the mixing container (64) into contact with the cryogenic liquid (22) in the enclosed chamber (20);

withdrawing a neon-rich gas stream from the separator vessel (40) by a conduit (42) and feeding it to the first heat exchanger (101);

withdrawing a neon-rich gas stream from the first heat exchanger (101) by a conduit (112) and feeding it to the second heat exchanger (102);

withdrawing a neon-rich gas stream from the second heat exchanger (102) by a conduit (114) and feeding it to the fifth conduit (76);

withdrawing part of the neon-rich gas stream by a conduit (116) communicating with the conduit (114) and feeding it to a first valve (118);

withdrawing the neon rich gas stream from the first valve (118) by a conduit (120) and feeding it to a tank (122) for collecting neon-rich gas;

withdrawing a neon-rich gas stream from the tank (122) by a conduit (124) and feeding it to a second valve (126); and feeding the neon-rich gas stream from valve (126) to a conduit (128) in communication with the third conduit (72) for adding neon-rich gas to the third conduit (72).

10. A method of lowering the temperature of a high temperature superconducting (HTSC) material which has a superconducting capacity when at a temperature in the range of about 27° K. to 77° K. comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen, with the mixture having up to about 10 mole percent of neon;

removing a gaseous stream having a neon-nitrogen mixture composition which is at least 95% neon from the enclosed chamber (20) by means of a first conduit (28) communicating with the enclosed chamber (20) and a first heat exchanger (101) and feeding it through the first heat exchanger (101) to warm it;

feeding the warmed neon-rich gaseous stream which is at least 95% neon from the first heat exchanger (101) to a second heat exchanger (102) by means of a second conduit (70) communicating with the first heat exchanger (101) and the second heat exchanger (102);

delivering the warmed neon-rich gaseous stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to cool the neon-rich gaseous stream;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing the said cooled neon-rich gaseous stream from the second heat exchanger (102) and delivering it to a cooling coil means (84) located in a pool of liquefied nitrogen (92) in a tank (90) by means of an eighth conduit (82);

withdrawing the further cooled neon-rich gaseous stream from the cooling coil means (84) and delivering it to the first heat exchanger (101) by means of a ninth conduit (99);

withdrawing a cold neon-rich stream which is at least 95% neon from the first heat exchanger (101) and delivering it to a first expansion valve (36) by means of a tenth conduit (34) and expanding the cold neon-rich stream through the first expansion valve (36) to produce a partially liquefied neon-rich stream;

feeding the partially liquefied neon-rich stream from the first expansion valve (36) to a separator vessel (40) by means of an eleventh conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding the cold lower pressure partially liquefied neon-rich stream expanded out of the second expansion valve (46) to a mixing container (64);

withdrawing a liquefied nitrogen-rich stream of cryogenic liquid (22) from the enclosed chamber (20) and feeding it to the mixing container (64) to form a composite liquefied gas stream, which is a mixture of the liquefied nitrogen-rich stream and the partially liquefied neon-rich stream;

feeding the composite liquefied gas stream from the mixing container (64) into contact with the cryogenic liquid (22) in the enclosed chamber (20);

withdrawing neon-rich gas from the separator vessel (40) by a conduit (42) and feeding it to the first heat exchanger (101);

withdrawing neon-rich gas from the first heat exchanger (101) by a conduit (112) and feeding it to the second heat exchanger (102);

withdrawing neon-rich gas from the second heat exchanger (102) by a conduit (114) and feeding it to the fifth conduit (76);

withdrawing part of the neon-rich gas stream by a conduit (116) communicating with the conduit (114) and feeding it to a first valve (118);

withdrawing the neon-rich gas stream from the first valve (118) by a conduit (120) and feeding it to a tank (122) for collecting neon-rich gas;

withdrawing a neon-rich gas stream from the tank (122) by a conduit (124) and feeding it to a second valve (126); and feeding the neon-rich gas stream from the second valve (126) to a conduit (128) in communication with the third conduit (72) for adding neon-rich gas to the third conduit (72).

11. A method according to claim 10 in which:

cold nitrogen gas is withdrawn from the tank (90) and fed through the second heat exchanger (102) for cooling purposes.

12. A method of lowering the temperature of a high temperature superconducting (HTSC) material comprising:

forming a pool of a cryogenic liquid (22) comprising a mixture of liquefied nitrogen and a small amount of liquefied neon in a first enclosed chamber (20);

continuously feeding a stream of the liquefied neon-nitrogen mixture from the first enclosed chamber (20) to a second enclosed chamber (203) containing a HTSC material (204) so that the liquefied neon-nitrogen mixture surrounds the HTSC material (204) and flows through the second enclosed chamber (203) thereby cooling the HTSC material by forced flow convection heat transfer;

withdrawing the liquefied neon-nitrogen mixture from the second enclosed chamber (203);

removing a neon-rich gaseous stream having a neon-nitrogen mixture composition which is at least 95% neon from the first enclosed chamber (20) by means of a first conduit (28) communicating with the first enclosed chamber (20) and a first heat exchanger (101) and feeding it through the first heat exchanger (101) to warm it;

feeding the warmed neon-rich gaseous stream which is at least 95% neon from the first heat exchanger (101) to a second heat exchanger (102) by means of a second conduit (70) communicating with the first heat exchanger (101) and the second heat exchanger (102);

delivering the warmed neon-rich gaseous stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74) to cool the gas stream;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to further cool the neon-rich gaseous stream;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing a cooled neon-rich gaseous stream from the second heat exchanger (102) and delivering it to the first heat exchanger (101) by means of an eighth conduit (130);

withdrawing a cooled neon-rich gaseous stream from the eighth conduit (130) and delivering it to an expander (134) by means of a ninth conduit (132);

withdrawing a further cooled neon-rich gaseous stream from the expander (134) and delivering it to the second conduit (70) by means of a tenth conduit (136) so that the further cooled neon-rich gas stream can mix with the gas stream which is at least 95% neon in the second conduit (70);

withdrawing a cold neon-rich stream which is at least 95% neon from the first heat exchanger (101) and delivering it to a first expansion valve (36) by means of an eleventh conduit (34) and expanding the cold neon-rich stream through the first expansion valve (36) to produce a partially liquefied neon-rich stream;

feeding the partially liquefied neon-rich stream from the first expansion valve (36) to a separator vessel (40) by means of a twelfth conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding the cold lower pressure partially liquefied neon-rich stream expanded out of the second expansion valve (46) to a mixing container (64);

feeding the liquefied neon-nitrogen stream withdrawn from the second enclosed chamber (203) to the mixing container (64); and withdrawing a composite liquefied gas stream, which is a mixture of the liquefied neon-nitrogen stream and the partially liquefied neon-rich stream, from the mixing container (64) and feeding it into the first enclosed chamber (20).

13. A method according to claim 12 including:

withdrawing a neon-rich gaseous stream from the separator vessel (40) and feeding it through the first heat exchanger (101) and second heat exchanger (102) for indirect cooling purposes.

14. A method according to claim 12 including:

withdrawing a neon-rich gaseous stream from the separator vessel (40) by a conduit (42) and feeding it to the first heat exchanger (101);

withdrawing a neon-rich gaseous stream from the first heat exchanger (101) by a conduit (112) and feeding it to the second heat exchanger (102);

withdrawing a neon-rich gaseous stream from the second heat exchanger (102) by a conduit (114) and feeding it to the fifth conduit (76);

withdrawing part of the neon-rich gaseous stream by a conduit (116) communicating with the conduit (114) and feeding it to a first valve (118);

withdrawing the neon-rich gaseous stream from the first valve (118) by a conduit (120) and feeding it to a tank (122) for collecting neon-rich gas;

withdrawing a neon-rich gaseous stream from the tank (122) by a conduit (124) and feeding it to a second valve (126); and feeding the neon-rich gaseous stream from valve (126) to a conduit (128) in communication with the third conduit (72) for adding neon-rich gas to the third conduit (72).

15. A method of lowering the temperature of a high temperature superconducting (HTSC) material comprising:

forming a pool of cryogenic liquid (22) comprising a mixture of liquefied nitrogen and a small amount of liquefied neon in a first enclosed chamber (20);

continuously feeding a stream of the liquefied neon-nitrogen mixture from the first enclosed chamber (20) to a second enclosed chamber (203) containing a HTSC material (204) so that the liquefied neon-nitrogen mixture surrounds the HTSC material (204) and flows through the second enclosed chamber (203) thereby cooling the HTSC material by forced flow convection heat transfer;

withdrawing the liquefied neon-nitrogen mixture from the second enclosed chamber (203);

removing a gaseous stream having a neon-nitrogen mixture composition which is at least 95% neon from the first enclosed chamber (20) by means of a first conduit means communicating with the first enclosed chamber (20) and with heat exchanger means and with compressor means for removing a neon-rich gaseous stream therefrom having a composition which is at least 95% neon and feeding it to the heat exchanger means and the compressor means to pressurize and cool the neon-rich gaseous stream to produce a cooled neon-rich gaseous stream which is at least 95% neon;

withdrawing a cooled neon-rich gaseous stream from the first conduit means and delivering it to a cooling coil means (84), located in a tank (90) containing a pool of liquefied nitrogen (92), by means of a second conduit means communicating with the first conduit means downstream of the compressors and upstream of some of the heat exchanger means, and then feeding the cooled neon-rich gaseous stream, exiting the cooling coil means (84), to a third conduit means;

feeding the cooled neon-rich gaseous stream from the second conduit means to a third conduit means communicating with the second conduit means downstream of the cooling coil means (84), the third conduit means including expansion valve means (46), expanding the cold neon-rich stream through the expansion valve means to a lower pressure to produce a partially liquefied neon-rich stream and delivering the said partially liquefied neon-rich stream from the expansion valve means (46) to a mixing container (64);

withdrawing the liquefied neon-nitrogen stream from the second enclosed chamber (203) and feeding it to the mixing container (64) to form a composite liquefied gas stream, which is a mixture of the liquefied neon-nitrogen stream and the partially liquefied neon-rich stream, in the mixing container (64); and feeding the composite liquefied gas stream from the mixing container (64) into the cryogenic liquid (22) in the first enclosed chamber (20).

16. A method of lowering the temperature of a high temperature superconducting (HTSC) material comprising:

forming a pool of a cryogenic liquid (22) comprising a mixture of liquefied nitrogen and a small amount of liquefied neon in a first enclosed chamber (20);

continuously feeding a stream of the liquefied neon-nitrogen mixture from the first enclosed chamber (20) to a second enclosed chamber (203) containing a HTSC material (204) so that the liquefied neon-nitrogen mixture surrounds the HTSC material (204) and flows through the second enclosed chamber (203) thereby cooling the HTSC material by forced flow convection heat transfer;

withdrawing the liquefied neon-nitrogen mixture from the second enclosed chamber (203);

removing a gaseous stream having a neon-nitrogen mixture composition which is at least 95% neon from the first enclosed chamber (20) by means of a first conduit (28) communicating with the first enclosed chamber (20) and a first heat exchanger (101) and feeding it through the first heat exchanger (101) to warm it;

feeding the warmed neon-rich gaseous stream which is at least 95% neon from the first heat exchanger (101) to a second heat exchanger (102) by means of a second conduit (70) communicating with the first heat exchanger (101) and the second heat exchanger (102);

delivering the warmed neon-rich gaseous stream which is at least 95% neon from the second heat exchanger (102) to a first compressor (201) by means of a third conduit (72);

delivering the compressed neon-rich gaseous stream which is at least 95% neon from the first compressor (201) to a third heat exchanger (103) by means of a fourth conduit (74)-to cool the gas;

delivering the cooled neon-rich gaseous stream which is at least 95% neon from the third heat exchanger (103) to a second compressor (202) by means of a fifth conduit (76);

delivering the compressed neon-rich gaseous stream which is at least 95% neon from the second compressor (202) to a fourth heat exchanger (104) by means of a sixth conduit (78) to further cool the neon-rich gaseous stream;

delivering the cooled neon-rich gaseous stream which is at least 95% neon from the fourth heat exchanger (104) to the second heat exchanger (102) by means of a seventh conduit (80) to further cool the neon-rich gaseous stream;

withdrawing the said cooled neon-rich gaseous stream from the second heat exchanger (102) and delivering it to a cooling coil means (84), located in a pool of liquefied nitrogen (92) in a tank (90), by means of an eighth conduit (82);

withdrawing a further cooled neon-rich gaseous stream from the cooling coil means (84) and delivering it to the first heat exchanger (101) by means of a ninth conduit (99);

withdrawing a cold neon-rich stream which is at least 95% neon from the first heat exchanger (101) and delivering it to a first expansion valve (36) by means of a tenth conduit (34) and expanding the cold neon-rich stream through the first expansion valve (36) to produce a partially liquefied neon-rich stream;

feeding the partially liquefied neon-rich stream from the first expansion valve (36) to a separator vessel (40) by means of an eleventh conduit (38);

withdrawing a liquefied neon-rich stream from the separator vessel (40), feeding it to a second expansion valve (46) by a conduit means (44) and expanding the liquefied neon-rich stream through the second expansion valve (46) to a lower pressure to cool it to a lower temperature;

feeding a cold lower pressure partially liquefied neon-rich stream expanded out of the second expansion valve (46) to a mixing container (64);

withdrawing the liquefied nitrogen-rich stream from the second enclosed chamber (203) and feeding it to the mixing container (64) to form a composite liquefied gas stream, which is a mixture of the liquefied nitrogen-rich stream and the partially liquefied neon-rich stream, in the mixing container (64); and feeding the composite liquefied gas stream from the mixing container (64) into the cryogenic liquid (22) in the first enclosed chamber (20).

17. A method according to claim 16 comprising:

withdrawing a neon-rich gaseous stream from the separator vessel (40) and feeding it through the first heat exchanger (101 and second heat exchanger (102) for indirect cooling purposes.

18. A method according to claim 16 comprising:

by means of a conduit (116) communicating with the conduit (114) withdrawing part of the neon-rich gaseous stream and feeding it to a first valve (118);

withdrawing the neon-rich gaseous stream from the first valve (118) by a conduit (120) and feeding it to a tank (122) for collecting neon-rich gas;

withdrawing a neon-rich gaseous stream from the tank (122) by a conduit (124) and feeding it to a second valve (126); and feeding the neon-rich gaseous stream from the second valve (126) to a conduit (128) in communication with the third conduit (72) for adding neon-rich gas to the third conduit (72).

19. A method according to claim 16 including:

withdrawing a cold nitrogen gas stream from tank (90) and feeding it through the second heat exchanger (102) for cooling purposes.

20. A method of lowering the temperature of a high temperature superconducting material comprising:

positioning a high temperature superconducting (HTSC) material (26) in an enclosed chamber (20) capable of holding a cryogenic liquid (22);

surrounding the HTSC material (26) with a pool of a cryogenic liquid (22) comprising a mixture of liquefied neon and liquefied nitrogen;

removing a gaseous neon-nitrogen mixture stream having a composition which is at least 95% neon from the enclosed chamber (20);

partially reliquefying the gaseous stream removed from the enclosed changer (20) to produce a partially liquefied neon-rich stream which is at least 95% neon;

feeding the partially liquefied neon-rich stream which is at least 95% neon into a separator vessel (40) at a high pressure of at least 100 psia and a low temperature at least as low as 35° K.;

withdrawing a liquefied neon-rich stream from the separator vessel (40) and feeding it to and through an expansion valve (46); and receiving a cold lower pressure neon-rich stream, which is at least 95% neon, expanded out of the expansion valve (46) and feeding it to the enclosed chamber (20) into contact with the cryogenic liquid (22) neon-nitrogen mixture therein.

21. A method of lowering the temperature of a high temperature superconducting material comprising:

positioning a high temperature superconducting (HTSC) material (26) in an enclosed changer (20) capable of holding a cryogenic liquid (22);

surrounding the HTSC material (26) with a pool of a cryogenic liquid (22) comprising a mixture of liquefied neon and liquefied nitrogen;

removing a gaseous stream having a neon-nitrogen mixture composition which is at least 95% neon from the enclosed chamber (20) by means of a first conduit means communicating with the enclosed chamber (20) and with heat exchanger means and with compressor means for removing a neon-rich gaseous stream therefrom having a composition which is at least 95% neon and feeding it to the heat exchanger means and the compressor means to pressurize and cool the neon-rich gaseous stream to produce a cooled neon-rich gaseous stream which is at least 95% neon;

withdrawing a cooled neon-rich gaseous stream from the first conduit means and delivering it to a cooling coil means located in a tank (90) adapted to hold liquefied nitrogen (92) by means of a second conduit means communicating with the first conduit means downstream of the compressors and upstream of some of the heat exchanger means, and then feeding the further cooled neon-rich gaseous stream, exiting the cooling coil means, to a third conduit means; and feeding the cooled neon-rich gaseous stream from the second conduit means to a third conduit means communicating with the second conduit means downstream of the cooling coil means and communicating with the enclosed chamber (20), the third conduit means including expansion valve means, expanding the cold neon-rich stream through the expansion valve means to a lower pressure to produce a lower pressure partially liquefied neon-rich stream and delivering the said partially liquefied neon-rich stream from the expansion valve means to the enclosed chamber (20).

22. A method of lowering the temperature of a high temperature superconducting (HTSC) material comprising:

forming a pool of a cryogenic liquid (22) comprising a mixture of liquefied nitrogen and a small amount of liquefied neon in a first enclosed chamber (20);

continuously feeding a stream of the liquefied neon-nitrogen mixture from the first enclosed chamber (20) to a second enclosed chamber (203) containing a HTSC material (204) so that the liquefied neon-nitrogen mixture surrounds the HTSC material (204) and flows through the second enclosed chamber (203) thereby cooling the HTSC material by forced flow convection heat transfer;

withdrawing the liquefied neon-nitrogen mixture from the second enclosed chamber (203);

removing a neon-rich gaseous stream having a composition which is at least 95% neon from the first enclosed chamber (20), compressing and cooling the neon-rich gaseous stream to produce a cooled neon-rich gaseous stream which is at least 95% neon;

feeding part of the cooled neon-rich gaseous stream which is at least 95% neon to an expander (134) and then withdrawing a further cooled neon-rich gaseous stream from the expander 9134) and returning it to the neon-rich gaseous stream withdrawn from the first enclosed chamber (20) before it is compressed;

further cooing and expanding the other part of the cooled neon-rich gaseous stream through an expansion valve means (46) to produce a partially liquefied neon-rich stream;

feeding the said partially liquefied neon-rich stream from the expansion valve means (46) into a mixing container (64);

feeding the liquefied nitrogen-rich stream withdrawn from the second enclosed chamber (203) to the mixing container (64); and withdrawing the composite liquefied gas stream, which is a mixture of the liquefied nitrogen-rich stream and the partially liquefied neon-rich stream, from the mixing container (64) and feeding it into the first enclosed chamber (20).

23. Apparatus comprising:

an enclosed chamber (20) capable of holding a cryogenic liquid;

a high temperature superconducting (HTSC) material (26) positioned within the enclosed chamber (20) so as to be at least substantially surrounded by a cryogenic liquid (22);

a pool of cryogenic liquid (22) in the enclosed chamber (20), said cryogenic liquid (22) comprising a mixture of liquefied nitrogen and a small amount of liquefied neon;

the enclosed chamber (20) having an outlet (28) for removing a gaseous stream having a composition which is at least 95% neon;

refrigeration means (30) for reliquefying the gaseous stream removed from the enclosed chamber (20) to produce a liquefied neon-rich stream which is at least 95% neon;

a separator vessel (40) capable of receiving a liquefied neon-rich stream which is at least 95% neon at a high pressure of at least 100 psia and a low temperature at least as low as 35° K.;

means for delivering said liquefied neon-rich stream from the refrigeration means (30) to the separator vessel (40);

means (44) communicating with the separator vessel (40) for withdrawing a liquefied neon-rich stream from the separator vessel (40) and feeding it to an expansion valve (46); and means (48) for receiving the cold lower pressure liquefied neon-rich stream expanded out of the expansion valve (46) and feeding it to the enclosed chamber (20) into contact with the liquefied neon-nitrogen mixture (22) therein.

24. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

a pool of cryogenic liquid (22) in the enclosed chamber (20), said cryogenic liquid (22) comprising a mixture of liquefied nitrogen and a small amount of liquefied neon;

the enclosed chamber (20) having means (28) for removing a gaseous stream having a composition which is at least 95% neon;

refrigeration means (30) for reliquefying the gaseous stream removed from the enclosed chamber (20) to produce a liquefied neon-rich stream which is at least 95% neon;

a separator vessel (40) capable of receiving a liquefied neon-rich stream which is at least 95% neon at a high pressure of at least 100 psia and a low temperature at least as low as 35° K.;

means for delivering said liquefied neon-rich stream from the refrigeration means (30) to the separator vessel (40);

means (44) communicating with the separator vessel (40) for withdrawing a liquefied neon-rich stream from the separator vessel (40) and feeding it to an expansion valve (46);

means (48) for receiving the colder lower pressure liquefied neon-rich stream expanded out of the expansion valve (46) and feeding it to a mixing container (64);

means to withdraw a liquefied neon-nitrogen mixture stream from the enclosed chamber (20) and feed it to the mixing container (64) in which the liquefied neon-nitrogen mixture stream and the liquefied neon-rich stream are mixed to form a composite liquefied gas; and means (66) for feeding the composite liquefied gas from the mixing container (64) to the enclosed chamber (20).

25. Apparatus according to claim 24 comprising:

means (42) to withdraw neon-rich gas from the separator vessel (40) and return it to the refrigeration means (30) to be reliquefied.

26. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

a pool of cryogenic liquid (22) in the enclosed chamber (20), said cryogenic liquid (22) comprising a mixture of liquefied nitrogen and a small amount of liquefied neon;

a first conduit (28) communicating with the enclosed chamber (20) and a first heat exchanger (101) for removing a gaseous stream therefrom having a composition which is at least 95% neon and feeding it to the first heat exchanger (101) to be warmed;

a second conduit (70) communicating with the first heat exchanger (101) and a second heat exchanger (102) for feeding the at least 95% neon warmed gaseous stream from the first heat exchanger (101) to the second heat exchanger (102);

a third conduit (72) communicating with the second heat exchanger (102) for delivering warmed gas which is at least 95% neon therefrom to a first compressor (201);

a fourth conduit (74) communicating with the first compressor (201) for delivering compressed gas which is at least 95% neon therefrom to a third heat exchanger (103) to cool the gas;

a fifth conduit (76) communicating with the third heat exchanger (103) for delivering cooled compressed gas which is at least 95% neon therefrom to a second compressor (202);

a sixth conduit (78) communicating with the second compressor (202) for delivering compressed gas which is at least 95% neon therefrom to a fourth heat exchanger (104) to cool the gas;

a seventh conduit (80) communicating with the fourth heat exchanger (104) for delivering the cooled compressed gas which is at least 95% neon to the second heat exchanger (102) to further cool the neon-rich stream;

an eighth conduit (130) communicating with the second heat exchanger (102) for withdrawing a further cooled neon-rich stream from the second heat exchanger (102) and delivering it to the first heat exchanger (101);

a ninth conduit (132) communicating with the eighth conduit (130) for withdrawing a cooled neon-rich stream therefrom and delivering it to an expander (134);

a tenth conduit (136) communicating with the expander (134) outlet for withdrawing a further cooled gaseous neon-rich stream therefrom and delivering it to the second conduit (70) so that the cold gaseous neon-rich stream can mix with the gas stream which is at least 95% neon in the second conduit (70); and means for withdrawing a liquefied neon-rich stream, which is at least 95% neon, from the first heat exchanger (101), expanding the liquefied neon-rich stream to a lower pressure to produce a colder liquefied neon-rich stream and delivering the said colder liquefied neon-rich stream to the enclosed chamber (20).

27. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

a pool of cryogenic liquid (22) in the enclosed chamber (20), said cryogenic liquid (22) comprising a mixture of liquefied nitrogen and a small amount of liquefied neon;

a first conduit (28) communicating with the enclosed chamber (20) and a first heat exchanger (101) for removing a gaseous stream therefrom having a composition which is at least 95% neon and feeding it to the first heat exchanger (101) to be warmed;

a second conduit (70) communicating with the first heat exchanger (101) and a second heat exchanger (102) for feeding the at least 95% neon warmed gaseous stream from the first heat exchanger (101) to the second heat exchanger (102);

a third conduit (72) communicating with the second heat exchanger (102) for delivering warmed gas which is at least 95% neon therefrom to a first compressor (201);

a fourth conduit (74) communicating with the first compressor (201) for delivering compressed gas which is at least 95% neon therefrom to a third heat exchanger (103) to cool the gas;

a fifth conduit (76) communicating with the third heat exchanger (103) for delivering cooled compressed gas which is at least 95% neon therefrom to a second compressor (202);

a sixth conduit (78) communicating with the second compressor (202) for delivering compressed gas which is at least 95% neon therefrom to a fourth heat exchanger (104) to cool the gas;

a seventh conduit (80) communicating with the fourth heat exchanger (104) for delivering the cooled compressed gas which is at least 95% neon to the second heat exchanger (102) to further cool the neon-rich stream;

an eighth conduit (130) communicating with the second heat exchanger (102) for withdrawing a further cooled neon-rich stream from the second heat exchanger (102) and delivering it to the first heat exchanger (101);

a ninth conduit (132) communicating with the eighth conduit (130) for withdrawing a cooled neon-rich stream therefrom and delivering it to an expander (134);

a tenth conduit (136) communicating with the expander (134) outlet for withdrawing a further cooled gaseous neon-rich stream therefrom and delivering it to the second conduit (70) so that the cold gaseous neon-rich stream can mix with the gas stream which is at least 95% neon in the second conduit (70);

an eleventh conduit (34) for withdrawing a cold neon-rich stream, which is at least 95% neon, from the first heat exchanger (101) and delivering it to a first expansion valve (36) through which the cold neon-rich stream can expand to a lower pressure to produce a colder partially liquefied neon-rich stream;

a twelfth conduit (38) communicating with the first expansion valve (36) and a separator vessel (40) for feeding the partially liquefied neon-rich stream from the first expansion valve (36) to the separator vessel (40);

a conduit means (44) communicating with the separator vessel (40) for withdrawing a liquefied neon-rich stream from the separator vessel (40) and feeding it to a second expansion valve (46);

conduit means (48) for receiving the colder lower pressure neon-rich stream expanded out of the second expansion valve (46) and feeding it to a mixing container (64);

means (58,60,62) to withdraw a liquefied nitrogen-rich stream from the enclosed chamber (20) and feed it to the mixing container (64) to form a composite liquefied gas comprising a mixture of the liquefied nitrogen-rich stream and the liquefied neon-rich stream in the mixing container (64); and conduit means (66) for feeding composite liquefied gas from the mixing container (64) to the enclosed chamber (20).

28. Apparatus according to claim 27 comprising:

means (42,112,114) to withdraw a neon-rich gas stream from the separator vessel (40) and feed it through the first (101) and second (102) heat exchangers for indirect cooling purposes.

29. Apparatus according to claim 27 comprising:

a conduit (42) communicating with the separator vessel (40) for withdrawing a neon-rich gas stream from the separator vessel (40) and feeding it to the first heat exchanger (101);

a conduit (112) for withdrawing a neon-rich gas stream from the first heat exchanger (101) and feeding it to the second heat exchanger (102);

a conduit (114) for withdrawing a neon-rich gas stream from the second heat exchanger (102) and feeding it to the fifth conduit (76);

a branch conduit (116) communicating with conduit (114) and valve (118);

a conduit (120) communicating with valve (118) and a tank (122) for collecting neon-rich gas;

a conduit (124) communicating with a tank (122) and a valve (126); and a conduit (128) communicating with a valve (126) and the third conduit (72) for removing a neon-rich gas stream from the tank (122) and feeding it to the third conduit (72).

30. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

a pool of cryogenic liquid (22) in the enclosed chamber (20), said cryogenic liquid (22) comprising a mixture of liquefied nitrogen and a small amount of liquefied neon;

a first conduit (28) means communicating with the enclosed chamber (20) and with heat exchanger means and with compressor means for removing a gaseous stream therefrom having a composition which is at least 95% neon and feeding it to the heat exchanger means and the compressor means to warm and pressurize the gaseous stream to produce a pressurized neon-rich stream which is at least 95% neon;

a second conduit means, communicating with the first conduit means downstream of the compressor means and upstream of some of the heat exchanger means, for withdrawing a cooled pressurized neon-rich stream from the first conduit means and delivering it to a cooling coil means (84) located in a tank (90) adapted to hold liquefied nitrogen and then feeding the further cooled pressurized neon-rich stream, exiting the cooling coil means (84), to a third conduit means; and the third conduit means communicating with the second conduit means downstream of the compressor means and communicating with the enclosed chamber (20), the third conduit means including expansion valve means, for feeding a cold pressurized neon-rich stream received from the second conduit means, expanding the cold pressurized neon-rich stream through the expansion valve means to a lower pressure to produce a colder liquefied neon-rich stream and delivering the said colder liquefied neon-rich stream from the expansion valve means through the third conduit means to the enclosed chamber (20).

31. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

the enclosed chamber (20) being adapted to hold a pool of cryogenic liquid (22), said cryogenic liquid

(22) comprising a mixture of liquefied nitrogen and a small amount of liquefied neon;

a first conduit (28) communicating with the enclosed chamber (20) and a first heat exchanger (101) for removing a gaseous neon-nitrogen mixture stream therefrom having a composition which is at least 95% neon and feeding it to the first heat exchanger (101) to be warmed;

a second conduit (70) communicating with the first heat exchanger (101) and a second heat exchanger (102) for feeding the at least 95% neon warmed gaseous stream from the first heat exchanger (101) to the second heat exchanger (102);

a third conduit (72) communicating with the second heat exchanger (102) for delivering warmed gas which is at least 95% neon therefrom to a first compressor (201);

a fourth conduit (74) communicating with the first compressor (201) for delivering compressed gas which is at least 95% neon therefrom to a third heat exchanger (103) to cool the gas;

a fifth conduit (76) communicating with the third heat exchanger (103) for delivering the cooled compressed gas which is at least 95% neon therefrom to a second compressor (202);

a sixth conduit (78) communicating with the second compressor (202) for delivering compressed gas which is at least 95% neon therefrom to a fourth heat exchanger (104) to cool the gas;

a seventh conduit (80) communicating with the fourth heat exchanger (104) for delivering the cooled compressed gas which is at least 95% neon to the second heat exchanger (102) to further cool the neon-rich stream;

an eighth conduit (82) communicating with the second heat exchanger (102) for withdrawing a further cooled neon-rich stream from the second heat exchanger (102) and delivering it to a cooling coil means (84) in a tank (90) adapted to hold liquefied nitrogen (92);

a ninth conduit (99) communicating with the cooling Coil means (84) for withdrawing a further cooled neon-rich stream therefrom and delivering it to the first heat exchanger (101); and means for withdrawing a cold neon-rich stream, which is at least 95% neon, from the first heat exchanger (101), expanding the cold neon-rich stream to a lower pressure to produce a colder partially liquefied neon-rich stream and delivering the said colder partially liquefied neon-rich stream to the enclosed chamber (20).

32. Apparatus comprising:

an enclosed chamber (20) capable of holding a cryogenic liquid (22);

a high temperature superconducting material (26) positioned within the enclosed chamber (20) so as to be at least substantially surrounded by a cryogenic liquid (22);

the enclosed chamber (20) being adapted to hold a pool of cryogenic liquid (22), said cryogenic liquid (22) comprising a mixture of liquefied nitrogen and a small amount of liquefied neon;

a first conduit (28) communicating with the enclosed chamber (20) and a first heat exchanger (101) for removing a gaseous neon-nitrogen mixture stream therefrom having a composition which is at least 95% neon and feeding it to the first heat exchanger (101) to be warmed;

a second conduit (70) communicating with the first heat exchanger (101) and a second heat exchanger (102) for feeding the warmed gaseous neon-nitrogen mixture stream which is at least 95% neon from the first heat exchanger (101) to the second heat exchanger (102);

a third conduit (72) communicating with the second heat exchanger (102) for delivering the warmed neon-nitrogen mixture gas which is at least 95% neon therefrom to a first compressor (201);

a fourth conduit (74) communicating with the first compressor (201) for delivering the said compressed gas which is at least 95% neon therefrom to a third heat exchanger (103) to cool the gas;

a fifth conduit (76) communicating with the third heat exchanger (103) for delivering the cooled neon-nitrogen mixture gas which is at least 95% neon therefrom to a second compressor (202);

a sixth conduit (78) communicating with the second compressor (202) for delivering the cooled compressed gas which is at least 95% neon therefrom to a fourth heat exchanger (104) to cool the gas;

a seventh conduit (80) communicating with the fourth heat exchanger (104) for delivering the said cooled compressed gas which is at least 95% neon to the second heat exchanger (102) to further cool the neon-rich stream;

an eighth conduit (82) communicating with the second heat exchanger (102) for withdrawing a further cooled neon-rich stream from the second heat exchanger (102) and delivering it therefrom to a cooling coil means (84) in a tank (90) adapted to hold liquefied nitrogen (92);

a ninth conduit (99) communicating with the cooling coil means (84) for withdrawing a further cooled neon-rich stream therefrom and delivering it to the first heat exchanger (101);

a tenth conduit (34) for withdrawing a cold neon-rich stream, which is at least 95% neon, from the first heat exchanger (101) and delivering it to a first expansion valve (36) through which the cold neon-rich stream can expand to a lower pressure to produce a colder partially liquefied neon-rich stream;

an eleventh conduit (38) communicating with the first expansion valve (36) and a separator vessel (40) for feeding the partially liquefied neon-rich stream from the first expansion valve (36) to the separator vessel (40);

a conduit means (44) communicating with the separator vessel (40) for withdrawing a liquefied neon-rich stream from the separator vessel (40) and feeding it to a second expansion valve (46);

conduit means (48) for receiving the cold lower pressure neon-rich stream expanded out of the second expansion valve (46) and feeding it to a mixing container (64);

means (58,60,62) to withdraw a liquefied nitrogen-rich stream from the enclosed chamber (20) and feed it to the mixing container (64) to form a composite liquefied gas comprising a mixture of the liquefied nitrogen-rich stream and the liquefied neon-rich stream in the mixing container (64); and conduit means (66) for feeding the composite liquefied gas from the mixing container (64) to the enclosed chamber (20).

33. Apparatus according to claim 32 comprising:

means (42,112,114) to withdraw neon-rich gas from the separator vessel (40) and feed it through the first (101) and second (102) heat exchangers for indirect cooling purposes.

34. Apparatus according to claim 32 comprising:

a conduit (42) communicating with the separator vessel (40) for withdrawing a neon-rich gas stream from the separator vessel (40) and feeding it to the first heat exchanger (101);

a conduit (112) for withdrawing a neon-rich gas stream from the first heat exchanger (101) and feeding it to the second heat exchanger (102);

a conduit (114) for withdrawing a neon-rich gas stream from the second heat exchanger (102) and feeding it to the fifth conduit (76);

a branch conduit (116) communicating with conduit (114) and a valve (118);

a conduit (120) communicating with a valve (118) and a tank 9122) for collecting neon-rich gas;

a conduit (124) communicating with a tank (122) and a valve (126); and a conduit (128) communicating with a valve (126) and the third conduit (72) for removing a neon-rich gas stream from the tank (122) and feeding it to the third conduit (72).

35. Apparatus comprising:

a first enclosed chamber (20) capable of holding a cryogenic liquid (22);

a pool of cryogenic liquid (22) in the first enclosed chamber (20), said cryogenic liquid (22) comprising a mixture of liquefied nitrogen and a small amount of liquefied neon;

a second enclosed chamber (203) capable of holding a cryogenic liquid;

a high temperature superconducting material (HTSC) (204) positioned within the second enclosed chamber (203);

a pool of cryogenic liquid in the second enclosed chamber (203) having essentially the same composition as the cryogenic liquid (22) in the first enclosed chamber (203);

a conduit means (58,60,62) for withdrawing cryogenic liquid (22) from the first enclosed chamber (20) and feeding it through the second enclosed chamber (203) with HTSC material (204) being in contact with and substantially surrounded by the cryogenic liquid as it flows through the second enclosed chamber (203) thereby cooling the HTSC material (204) by forced flow convection heat transfer;

a mixing container (64);

a conduit (63) for withdrawing a liquefied nitrogen-rich stream from the second enclosed chamber (203) and feeding it to the mixing container (64);

a first conduit (28) communicating with the first enclosed chamber (20) and a first heat exchanger (101) for removing a gaseous stream therefrom having a composition which is at least 95% neon and feeding it to the first heat exchanger (101) to be warmed;

a second conduit (70) communicating with the first heat exchanger (101) and a second heat exchanger (102) for feeding the at least 95% neon warmed gaseous stream from the first heat exchanger (101) to the second heat exchanger (102);

a third conduit (72) communicating with the second heat exchanger (102) for delivering warmed gas which is at least 95% neon therefrom to a first compressor (201);

a fourth conduit (74) communicating with the first compressor (201) for delivering compressed gas which is at least 95% neon therefrom to a third heat exchanger (103) to cool the gas;

a fifth conduit (76) communicating with the third heat exchanger (103) for delivering cooled compressed gas which is at least 95% neon therefrom to a second compressor (202);

a sixth conduit (78) communicating with the second compressor (202) for delivering compressed gas which is at least 95% neon therefrom to a fourth heat exchanger (104) to cool the gas;

a seventh conduit (80) communicating with the fourth heat exchanger (104) for delivering the cooled compressed gas which is at least 95% neon to the second heat exchanger (102) to further cool the neon-rich gas;

an eighth conduit (130) communicating with the second heat exchanger (102) for withdrawing a further cooled neon-rich stream from the second heat exchanger (102) for delivering it to the first heat exchanger (101);

a ninth conduit (132) communicating with the eighth conduit (130) for withdrawing a cooled neon-rich stream therefrom and delivering it to an expander (134);

a tenth conduit (136) communicating with the expander (134) for withdrawing a further cooled gaseous neon-rich stream therefrom and delivering it to the second conduit (70) so that the cold gaseous neon-rich stream can mix with the gas stream which is at least 95% neon in the second conduit (70);

means for withdrawing a cold neon-rich stream, which is at least 95% neon, from the first heat exchanger (101), expanding the cold neon-rich stream to a lower pressure to produce a colder partially liquefied neon-rich stream and delivering the said colder partially liquefied neon-rich stream to the mixing container (64); and conduit (66) means for withdrawing the composite liquefied neon-nitrogen mixture from the mixing container (64) and feeding it to the first enclosed chamber (20).

36. Apparatus comprising:

a first enclosed chamber (20) capable of holding a cryogenic liquid (22);

a pool of cryogenic liquid (22) in the first enclosed chamber (20), said cryogenic liquid (22) comprising a mixture of liquefied nitrogen and a small amount of liquefied neon;

a second enclosed chamber (203) capable of holding a cryogenic liquid;

a high temperature superconducting material (HTSC) (204) positioned within the second enclosed chamber (203);

a pool of cryogenic liquid in the second enclosed chamber (203) having essentially the same composition as the cryogenic liquid in the first enclosed chamber (20);

a conduit means (58,60,62) for withdrawing cryogenic liquid from the first enclosed chamber (20) and feeding it through the second enclosed chamber (203) with HTSC material being in contact with and substantially surrounded by the cryogenic liquid as it flows through the second enclosed chamber (203) thereby cooling the HTSC material by forced flow convection heat transfer;

a mixing container (64);

a conduit (63) for withdrawing a liquefied nitrogen rich stream from the second enclosed chamber (203) and feeding it to the mixing container (64);

a first conduit (28) communicating with the first enclosed chamber (20) and a first heat exchanger (101) for removing a gaseous stream therefrom having a composition which is at least 95% neon and feeding it to the first heat exchanger (101) to be warmed;

a second conduit (70) communicating with the first heat exchanger (101) and a second heat exchanger (102) for feeding the at least 95% neon warmed gaseous stream from the first heat exchanger (101) to the second heat exchanger (102);

a third conduit (72) communicating with the second heat exchanger (102) for delivering warmed gas which is at least 95% neon therefrom to a first compressor (201);

a fourth conduit (74) communicating with the first compressor (201) for delivering compressed gas which is at least 95% neon therefrom to a third heat exchanger (103) to cool the gas;

a fifth conduit (76) communicating with the third heat exchanger (103) for delivering cooled compressed gas which is at least 95% neon therefrom to a second compressor (202);

a sixth conduit (78) communicating with the second compressor (202) for delivering compressed gas which is at least 95% neon therefrom to a fourth heat exchanger (104) to cool the gas;

a seventh conduit (80) communicating with the fourth heat exchanger (104) for delivering the cooled compressed gas which is at least 95% neon to the second heat exchanger (102) to further cool the neon-rich gas;

an eighth conduit (130) communicating with the second heat exchanger (102) for withdrawing a further cooled neon-rich stream from the second heat exchanger (102) for delivering it to the first heat exchanger (101);

a ninth conduit (132) communicating with the eighth conduit (130) for withdrawing a cooled neon-rich stream therefrom and delivering it to an expander (134);

a tenth conduit (136) communicating with the expander (134) outlet for withdrawing a further cooled gaseous neon-rich stream therefrom and delivering it to the second conduit (70) so that the cold gaseous neon-rich stream can mix with the gas stream which is at least 95% neon in the second conduit (70);

an eleventh conduit (34) for withdrawing a cold neon-rich stream, which is at last 95% neon, from the first heat exchanger (101) and delivering it to a first expansion valve (36) through which the cold neon-rich stream can expand to a lower pressure to produce a colder partially liquefied neon-rich stream;

a twelfth conduit (38) communicating with the first expansion valve (36) and a separator vessel (40) for feeding the partially liquefied neon-rich stream from the first expansion valve (36) to the separator vessel (40);

a conduit means (44) communicating with the separator vessel (40) for withdrawing a liquefied neon rich stream from the separator vessel (40) and feeding it to a second expansion valve (46);

conduit means (48) for receiving the cold lower pressure partially liquefied neon-rich stream expanded out of the second expansion valve (46) and feeding it to a mixing container (64);

a conduit means (63) to withdraw a liquefied nitrogen-rich stream from the second enclosed chamber (203) and feed it to the mixing container (64) to form a composite liquefied gas comprising a mixture of the liquefied nitrogen-rich stream and the partially liquefied neon-rich stream in the mixing container (64); and conduit means (66) for feeding composite liquefied gas from the mixing container (64) to the first enclosed chamber (20).

37. Apparatus according to claim 36 comprising:

means (42,112,114) to withdraw a neon-rich gas stream from the separator vessel (40) and feed it through the first (101) and second (102) heat exchangers for indirect cooling purposes.

38. Apparatus according to claim 36 comprising:

a conduit (42) communicating with the separator vessel (40) for withdrawing neon-rich gas from the separator vessel (40) and feeding it to the first heat exchanger (101);

a conduit (112) for withdrawing neon-rich gas from the first heat exchanger (101) and feeding it to the second heat exchanger (102);

a conduit (114) for withdrawing neon-rich gas from the second heat exchanger (102) and feeding it to the fifth conduit (76);

a branch conduit (116) communicating with conduit (114) and a first valve (118);

a conduit (120) communicating with the first valve (118) and a tank (122) for collecting neon-rich gas;

a conduit (124) communicating with the tank (122) and a second valve (126); and a conduit (128) communicating with the second valve (126) and the third conduit (72) for adding neon-rich gas to the third conduit (72).

* * * * *